US011657749B2

(12) United States Patent
Ha et al.

(10) Patent No.: US 11,657,749 B2
(45) Date of Patent: May 23, 2023

(54) DISPLAY DEVICE HAVING ADJUSTED DRIVING VOLTAGE BASED ON CHANGE IN IMAGE SIGNAL

(71) Applicant: SAMSUNG DISPLAY CO., LTD., Yongin-si (KR)

(72) Inventors: Tae-Seok Ha, Hwaseong-si (KR); Kyoungsoo Kim, Suwon-si (KR); Kyu-Jin Park, Hwaseong-si (KR); Sung-Jae Park, Seongnam-si (KR); Seung-Woon Shin, Asan-si (KR); Ho Lee, Seoul (KR); Woon-Rok Jang, Cheonan-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/647,470

(22) Filed: Jan. 10, 2022

(65) Prior Publication Data

US 2022/0343825 A1 Oct. 27, 2022

(30) Foreign Application Priority Data

Apr. 22, 2021 (KR) ..... 10-2021-0052116

(51) Int. Cl.

| | |
|---|---|
| ***G09G 3/20*** | (2006.01) |
| ***G09G 3/3275*** | (2016.01) |
| ***G09G 3/3266*** | (2016.01) |

(52) U.S. Cl.

CPC ..... *G09G 3/2007* (2013.01); *G09G 3/3266* (2013.01); *G09G 3/3275* (2013.01); *G09G 2310/0243* (2013.01); *G09G 2310/08* (2013.01); *G09G 2330/021* (2013.01)

(58) Field of Classification Search

CPC ..... G09G 3/2007
USPC ..... 345/690
See application file for complete search history.

(56) References Cited

U.S. PATENT DOCUMENTS

| | | | |
|---|---|---|---|
| 2009/0278866 | A1 | 11/2009 | Kim |
| 2015/0243211 | A1 | 8/2015 | Pyo |
| 2019/0182509 | A1 | 6/2019 | Kim et al. |

(Continued)

FOREIGN PATENT DOCUMENTS

| | | |
|---|---|---|
| KR | 10-2009-0116874 | 11/2009 |
| KR | 10-2019-0071020 | 6/2019 |
| KR | 10-2205798 | 1/2021 |

*Primary Examiner* — Long D Pham
(74) *Attorney, Agent, or Firm* — F. Chau & Associates, LLC

(57) ABSTRACT

A display device includes a controller, a panel driver, and a voltage generator. The controller generates a first control signal and generates image data and a second control signal in response to first and second image signals. The panel driver generates a driving signal in response to the image data and the first control signal to drive a display panel. The voltage generator generates a driving voltage to drive the display panel and changes a voltage level of the driving voltage in response to the second control signal. The first image signal corresponds to a second frame located before a third frame in which the driving voltage is changed. The second image signal corresponds to a first frame located before the second frame. The controller generates image data corresponding to the second frame in response to the first image signal and the second image signal.

22 Claims, 13 Drawing Sheets

(56) References Cited

U.S. PATENT DOCUMENTS

| | | | | |
|---|---|---|---|---|
| 2020/0066207 | A1* | 2/2020 | Gu | G09G 3/3266 |
| 2021/0043149 | A1* | 2/2021 | Yoo | G09G 3/3291 |

* cited by examiner

DISPLAY DEVICE HAVING ADJUSTED DRIVING VOLTAGE BASED ON CHANGE IN IMAGE SIGNAL

CROSS-REFERENCE TO RELATED APPLICATION

This U.S. non-provisional patent application claims priority under 35 U.S.C. § 119 of Korean Patent Application No. 10-2021-0052116, filed on Apr. 22, 2021, the contents of which are hereby incorporated by reference in its entirety.

BACKGROUND

1. Field of Disclosure

One or more embodiments described herein relate to a display device.

2. Description of the Related Art

Televisions, mobile phones, tablet computers, navigation units, gaming devices and other products have various types of displays. Examples include organic light emitting displays and quantum dot light emitting displays, among others. As more innovative products are developed to meet consumer demand, the use and manufacture of these displays is only expected to continue. Efforts are continually being made to improve these displays, while also expanding their functionality.

SUMMARY

One or more embodiments described herein relate to a display device. At least some of these embodiments may provide a display device which is capable of reducing a power consumption and preventing the display quality of images from being deteriorated.

Embodiments of the inventive concept provide a display device including a display panel configured to display an image and a controller configured to generate a first control signal and a second control signal in response to a first image signal and a second image signal. The display device includes a panel driver configured to receive the image data and the first control signal from the controller and to generate a driving signal in response to the image data and the first control signal to drive the display panel. The display device includes a voltage generator configured to generate a driving voltage to drive the display panel and to change a voltage level of the driving voltage in response to the second control signal. The first image signal corresponds to a second frame located before a third frame in which the driving voltage is changed, and the second image signal corresponds to a first frame located before the second frame. The controller generates the image data corresponding to the second frame in response to the first image signal and the second image signal.

The voltage generator is configured to change a voltage level of the driving voltage in the third frame when a grayscale value of the first image signal is different from a grayscale value of the second image signal.

The controller generates the image data corresponding to the second frame in response to the first image signal and a correction signal, and the correction signal is generated based on a difference between the grayscale value of the first image signal and the grayscale value of the second image signal.

The correction signal includes information corresponding to the voltage level of the driving voltage, which is changed in response to the second control signal.

The first control signal includes a source control signal and a gate control signal. The panel driver includes a source driver configured to receive the image data and the source control signal, generate a data signal in response to the image data, and transmit the data signal to the display panel and a gate driver including a first scan line and a second scan line and the gate driver configured to sequentially transmit scan signals generated in response to the gate control signal to the display panel via the first and second scan lines.

The voltage generator is configured to change the voltage level of the driving voltage in the third frame to be greater than a voltage level of the driving voltage in the second frame when the grayscale value of the first image signal is greater than the grayscale value of the second image signal.

The controller is configured to generate a correction image signal in response to the first image signal and the correction signal and to generate the image data corresponding to the second frame based on the correction image signal. The correction image signal has a grayscale value greater than the grayscale value of the first image signal.

The voltage generator is configured to change the voltage level of the driving voltage in the third frame to be less than a voltage level of the driving voltage in the second frame when the grayscale value of the first image signal is less than the grayscale value of the second image signal.

The controller is configured to generate a correction image signal in response to the first image signal and the correction signal and to generate the image data corresponding to the second frame based on the correction image signal. The correction image signal has a grayscale value less than the grayscale value of the first image signal.

The first image signal includes a first sub-image signal corresponding to the first scan line and a second sub-image signal corresponding to the second scan line. The correction signal includes a first sub-correction signal corresponding to the first scan line and a second sub-correction signal corresponding to the second scan line. The controller is configured to generate a first sub-correction image signal in response to the first sub-image signal and the first sub-correction signal, a second sub-correction image signal in response to the second sub-image signal and the second sub-correction signal, and the image data corresponding to the second frame in response to the first and second sub-correction image signals. A grayscale value of the first sub-correction image signal is different from a grayscale value of the second sub-correction image signal.

The voltage generator is configured to change the voltage level of the driving voltage in the third frame to be greater than a voltage level of the driving voltage in the second frame when the grayscale value of the first image signal is greater than the grayscale value of the second image signal. The grayscale value of the first sub-correction image signal is greater than the grayscale value of the second sub-correction image signal.

The voltage generator is configured to change the voltage level of the driving voltage in the third frame to be less than the voltage level of the driving voltage in the second frame when the grayscale value of the first image signal is less than the grayscale value of the second image signal.

The grayscale value of the first sub-correction image signal is less than the grayscale value of the second sub-correction image signal.

The controller includes a data generator configured to generate the image data corresponding to the second frame in response to the first and second image signals.

The data generator includes a memory configured to store the second image signal, a compensator configured to receive the first and second image signals and to generate a correction image signal based on a correction signal, the correction signal generated in response to a difference between a grayscale value of the first image signal and a grayscale value of the second image signal and the first image signal, and a generator configured to generate the image data corresponding to the second frame in response to the correction image signal.

The data generator further includes a look-up table configured to store a correction table generated based on the difference between the grayscale value of the first image signal and the grayscale value of the second image signal. The compensator is configured to read out, from the correction table, the correction signal which corresponds to the difference between the grayscale value of the first image signal and the grayscale value of the second image signal, from the correction table stored in the look-up table.

The correction signal includes information corresponding to the voltage level of the driving voltage, which is changed in response to the second control signal.

The panel driver includes a gate driver including a first scan line and a second scan line wherein the gate driver is configured to sequentially transmit to the display panel scan signals generated in response to the first control signal via the first and second scan lines.

The first image signal includes a first sub-image signal corresponding to the first scan line and a second sub-image signal corresponding to the second scan line. The correction signal includes a first sub-correction signal corresponding to the first scan line and a second sub-correction signal corresponding to the second scan line.

The correction image signal includes a first sub-correction image signal corresponding to the first scan line and a second sub-correction image signal corresponding to the second scan line. The compensator is configured to generate the first sub-correction image signal in response to the first sub-image signal and the first sub-correction signal and to generate the second sub-correction image signal in response to the second sub-image signal and the second sub-correction signal. A grayscale value of the first sub-correction image signal is different from a grayscale value of the second sub-correction image signal.

The display panel includes a plurality of pixels. The driving voltage includes a first driving voltage and a second driving voltage having a voltage level less than a voltage level of the first driving voltage. One of the plurality of pixels includes a light emitting diode, a first power line configured to receive the first driving voltage, a driving transistor electrically connected between the first power line and an anode of the light emitting diode, and a second power line electrically connected to a cathode of the light emitting diode and receiving the second driving voltage.

The voltage generator is configured to change the voltage level of the first driving voltage.

BRIEF DESCRIPTION OF THE DRAWINGS

The above and other features of the present disclosure will become readily apparent by reference to the following detailed description when considered in conjunction with the accompanying drawings wherein.

DETAILED DESCRIPTION

Figure 1:
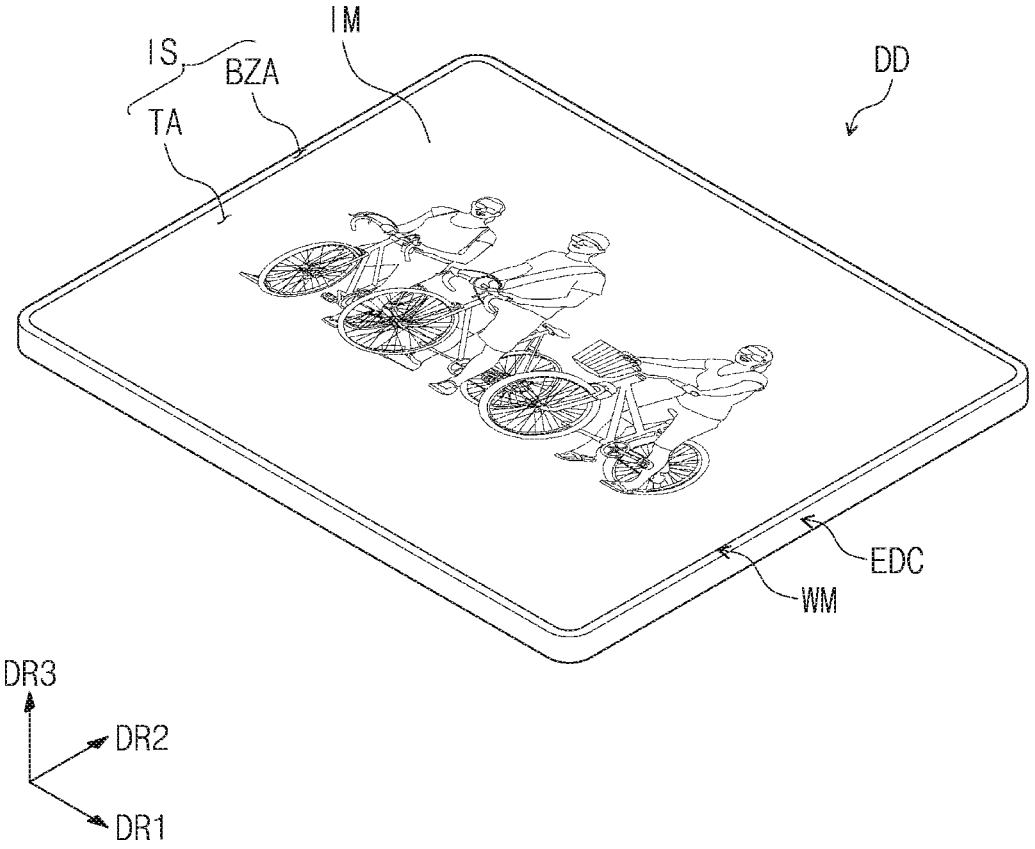
FIG. 1 illustrates an embodiment of a display device.

In the present disclosure, it will be understood that when an element or layer is referred to as being "on", "connected to" or "coupled to" another element or layer, it can be directly on, connected or coupled to the other element or layer or intervening elements or layers may be present. Like numerals refer to like elements throughout. In the drawings, the thickness, ratio, and dimension of components are exaggerated for effective description of the technical content. As used herein, the term "and/or" includes any combination of one or more of the associated listed items.

It will be understood that, although the terms first, second, etc., may be used herein to describe various elements, these elements should not be limited by these terms. These terms are only used to distinguish one element from another element. Thus, a first element discussed below could be termed a second element without departing from the teachings of the present disclosure. As used herein, the singular forms, "a", "an" and "the" are intended to include the plural forms as well, unless the context clearly indicates otherwise.

Spatially relative terms, such as "beneath", "below", "lower", "above", "upper" and the like, may be used herein for ease of description to describe one element or feature's relationship to another element(s) or feature(s) as illustrated in the figures. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, terms (including technical and scientific terms) used herein have a meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present disclosure will be explained in detail with reference to the accompanying drawings.

Figure 2:
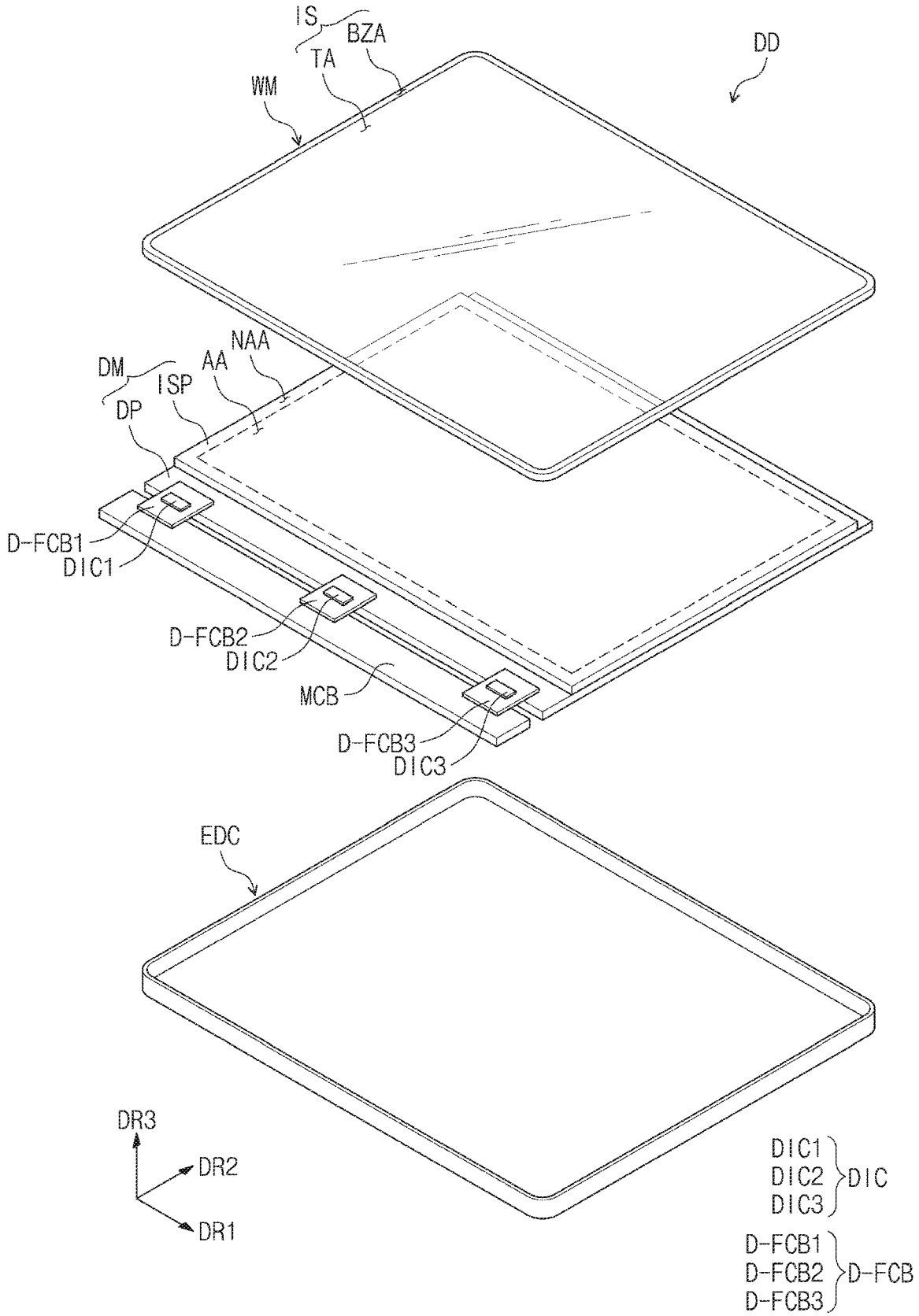
FIG. 2 illustrates an exploded view of the display device of FIG. 1.

FIG. 1 is a perspective view showing a display device DD according to an embodiment, and FIG. 2 is an exploded perspective view showing the display device DD shown in FIG. 1.

Referring to FIGS. 1 and 2, the display device DD may be activated in response to an electrical signal. The display device DD may be applied to a relatively large-sized display device (e.g., television set, monitor, etc.) or relatively small and medium-sized display devices, such as a mobile phone, a tablet computer, a car navigation unit, or a game unit. However, this is merely one example, and the display device DD may be applied to other electronic devices.

The display device DD may have a predetermined (e.g., rectangular) shape. When rectangular, the display device may include long sides extending in a first direction DR1 and short sides extending in a second direction DR2 crossing the first direction DR1. However, the shape of the display device DD should not be limited to the rectangular shape, and the display device DD may have a variety of shapes. The display device DD may display an image IM toward a third direction DR3 through a display surface IS that is substantially parallel to each of the first direction DR1 and the second direction DR2. The display surface IS through which the image IM is displayed may correspond to a front surface of the display device DD.

In the present embodiment, front (or upper) and rear (or lower) surfaces of each member may be defined with respect to the third direction DR3 in which the image IM is displayed. The front and rear surfaces are opposite to each other in the third direction DR3, and a normal line direction of each of the front and rear surfaces may be substantially parallel to the third direction DR3.

A separation distance in the third direction DR3 between the front surface and the rear surface may correspond to a thickness of the display device DD. Directions indicated by the first, second, and third directions DR1, DR2, and DR3 may be relative each other and may be changed in other directions.

The display device DD may sense external inputs which may vary in type. According to one embodiment, the display device DD may sense a user input applied from the outside. The user input may include one of various forms of external inputs. Examples include a touch from a portion of the body of a user, light, heat, or pressure, or a combination thereof. In addition, the display device DD may sense an external input by a user applied to a side or rear surface of the display device DD, depending, for example, on a structure of the display device DD. The display device DD may sense other types of inputs as well. For example, according to an embodiment, the display device DD may sense inputs generated by an input device, e.g., a stylus pen, an active pen, a touch pen, an electronic pen, an e-pen, or the like other than the external input by the user.

The front surface of the display device DD may include a transmission area TA and a bezel area BZA. The transmission area TA may transmit an image IM for display. The user may view the image IM through the transmission area TA. In the present embodiment, the transmission area TA may have a quadrangular shape with rounded vertices, but may have a different shape in another embodiment.

The bezel area BZA may be adjacent to the transmission area TA and may have a predetermined color. In one embodiment, the bezel area BZA may surround the transmission area TA. Accordingly, in some cases the transmission area TA may have a shape defined by the bezel area BZA, however this is merely one example. According to an embodiment, the bezel area BZA may be disposed adjacent to only one side of the transmission area TA or may be omitted altogether. According to an embodiment, the display device DD may include various embodiments and should not be particularly limited.

As shown in FIG. 2, the display device DD may include a display module DM and a window WM disposed on the display module DM. The display module DM may include a display panel DP and an input sensing layer ISP.

According to an embodiment, the display panel DP may be a light-emitting type display panel, e.g., an organic light emitting display panel or a quantum dot light emitting display panel. A light emitting layer of the organic light emitting display panel may include an organic light emitting material. A light emitting layer of the quantum dot light emitting display panel may include a quantum dot or a quantum rod. The display panel DP may output the image IM for display through the display surface IS.

The input sensing layer ISP may be disposed on the display panel DP to sense an external input. The input sensing layer ISP may be disposed directly on the display panel DP. According to an embodiment, the input sensing layer ISP may be formed on the display panel DP through successive processes. For example, when the input sensing layer ISP is disposed directly on the display panel DP, an adhesive film may not be disposed between the input sensing layer ISP and the display panel DP. However, an inner adhesive film may be disposed between the input sensing layer ISP and the display panel DP. In this case, the input sensing layer ISP is not manufactured together with the display panel DP through the successive processes. For example, the input sensing layer ISP may be fixed to an upper surface of the display panel DP by the inner adhesive film after being manufactured through a separate process from the display panel DP. According to an embodiment, the display device DD may not include the input sensing layer ISP.

The window WM may include a transparent material that transmits the image IM. The transparent material may include, for example, a glass, sapphire, or plastic material. The window WM may have a single-layer structure or may include a plurality of layers.

In one embodiment, the bezel area BZA of the display device DD may be defined by printing a material having a predetermined color on an area of the window WM. As an example, the window WM may include a light blocking pattern to define the bezel area BZA. The light blocking pattern may be a colored organic layer and may be formed by a coating method.

The window WM may be coupled with the display module DM by an adhesive film. As an example, the adhesive film may include an optically clear adhesive film (OCA) or another type of adhesive film, e.g., one including an ordinary adhesive. For example, the adhesive film may include an optically clear resin (OCR) or a pressure sensitive adhesive film (PSA).

An anti-reflective layer may be further disposed between the window WM and the display module DM. The anti-reflective layer may reduce a reflectance of an external light incident thereto from the above of the window WM. According to an embodiment, the anti-reflective layer may include a retarder and a polarizer. The retarder may be a film type or liquid-crystal-coating type and, for example, may include a $\lambda/2$ retarder and/or a $\lambda/4$ retarder. The polarizer may be a film type or liquid-crystal-coating type. The film-type retarder and the film-type polarizer may include a stretching-type synthetic resin film. The liquid crystal coating type retarder and the liquid crystal coating type polarizer may include liquid crystals aligned in a predetermined alignment. The retarder and the polarizer may be implemented as one polarizing film in one embodiment.

As an example, the anti-reflective layer may include color filters. Arrangements of the color filters may be determined by taking into account colors of lights generated by a plurality of pixels PX11 to PXnm (e.g., refer to FIG. 3) included in the display panel DP. In one embodiment, the anti-reflective layer may further include a light blocking pattern.

The display module DM may display the image IM in response to electrical signals and may transmit/receive information on the external input. The display module DM may include an effective area AA and a non-effective area NAA. The effective area AA may be an area through which the image provided from the display module DM is transmitted. In addition, the effective area AA may be an area in which the input sensing layer ISP senses an external input.

The non-effective area NAA may be adjacent to the effective area AA. For example, the non-effective area NAA may surround the effective area AA. However, this is merely one example, and the non-effective area NAA may be defined in various shapes and should not be particularly limited. According to an embodiment, the effective area AA of the display module DM may correspond to at least a portion of the transmission area TA.

In one embodiment, the display module DM may further include a main circuit board MCB, a plurality of flexible circuit films D-FCB, and a plurality of driving chips DIC. The main circuit board MCB may be connected to the flexible circuit films D-FCB and may be electrically connected to the display panel DP. The flexible circuit films D-FCB may be connected to the display panel DP and may electrically connect the display panel DP to the main circuit board MCB. The main circuit board MCB may include a plurality of driving elements. The driving elements may include a circuit to drive the display panel DP. The driving chips DIC may be mounted on the flexible circuit films D-FCB.

As an example, the flexible circuit films D-FCB may include a first flexible circuit film D-FCB1, a second flexible circuit film D-FCB2, and a third flexible circuit film D-FCB3. The driving chips DIC may include a first driving chip DIC1, a second driving chip DIC2, and a third driving chip DIC3. In this case, the first, second, and third flexible circuit films D-FCB1, D-FCB2, and D-FCB3 may be spaced apart from each other in the first direction DR1 and may be connected to the display panel DP to electrically connect the display panel DP and the main circuit board MCB. The first driving chip DIC1 may be mounted on the first flexible circuit film D-FCB1. The second driving chip DIC2 may be mounted on the second flexible circuit film D-FCB2. The third driving chip DIC3 may be mounted on the third flexible circuit film D-FCB3. However, the present disclosure should not be limited thereto.

As an example, the display panel DP may be electrically connected to the main circuit board MCB via one flexible circuit film, and only one driving chip may be mounted on the one flexible circuit film. In one embodiment, the display panel DP may be electrically connected to the main circuit board MCB via four or more flexible circuit films, and driving chips may be respectively mounted on the flexible circuit films.

As an example, the flexible circuit films may be connected to the display panel DP in different directions from each other. The flexible circuit films may be respectively connected to the long side of the display panel DP which extends in the first direction DR1, and the short side of the display panel DP which extends in the second direction DR2. In this case, the display module DM may further include a main circuit board electrically connected to the display panel DP via the flexible circuit film connected to the long side of the display panel DP and a main circuit board electrically connected to the display panel DP via the flexible circuit film connected to the short side of the display panel DP.

In addition, the flexible circuit films may be connected to the display panel DP in a direction where the flexible circuit films face each other, and the display module DM may further include main circuit boards electrically connected to the display panel DP in a direction where the main circuit boards face each other.

FIG. 2 shows a structure in which the first, second, and third driving chips DIC1, DIC2, and DIC3 are respectively mounted on the first, second, and third flexible circuit films D-FCB1, D-FCB2, and D-FCB3, however the present disclosure should not be limited thereto. As an example, the first, second, and third driving chips DIC1, DIC2, and DIC3 may be directly mounted on the display panel DP. In this case, portions of the display panel DP on which the first, second and third driving chips DIC1, DIC2 and DIC3 are mounted may be bent to be disposed on a rear surface of the display module DM.

The input sensing layer ISP may also be electrically connected to the main circuit board MCB via the flexible circuit film D-FCB, however the present disclosure should not be limited thereto. For example, the display module DM may further include a separate flexible circuit film to electrically connect the input sensing layer ISP to the main circuit board MCB.

The display device DD may further include an external case EDC accommodating the display module DM. The external case EDC may be coupled with the window WM to define an appearance of the display device DD. The external case EDC may absorb external impact applied thereto and may prevent foreign substances and moisture from entering the display module DM to protect components in the external case EDC. As an example, the external case EDC may be provided in a form in which a plurality of storage members is combined with each other.

According to an embodiment, the display device DD may further include an electronic module including various functional modules to operate the display module DM, a power supply module supplying power for overall operation of the display device DD, and a bracket coupled to the display module DM and/or the external case EDC to divide an inner space of the display device DD.

Figure 3:
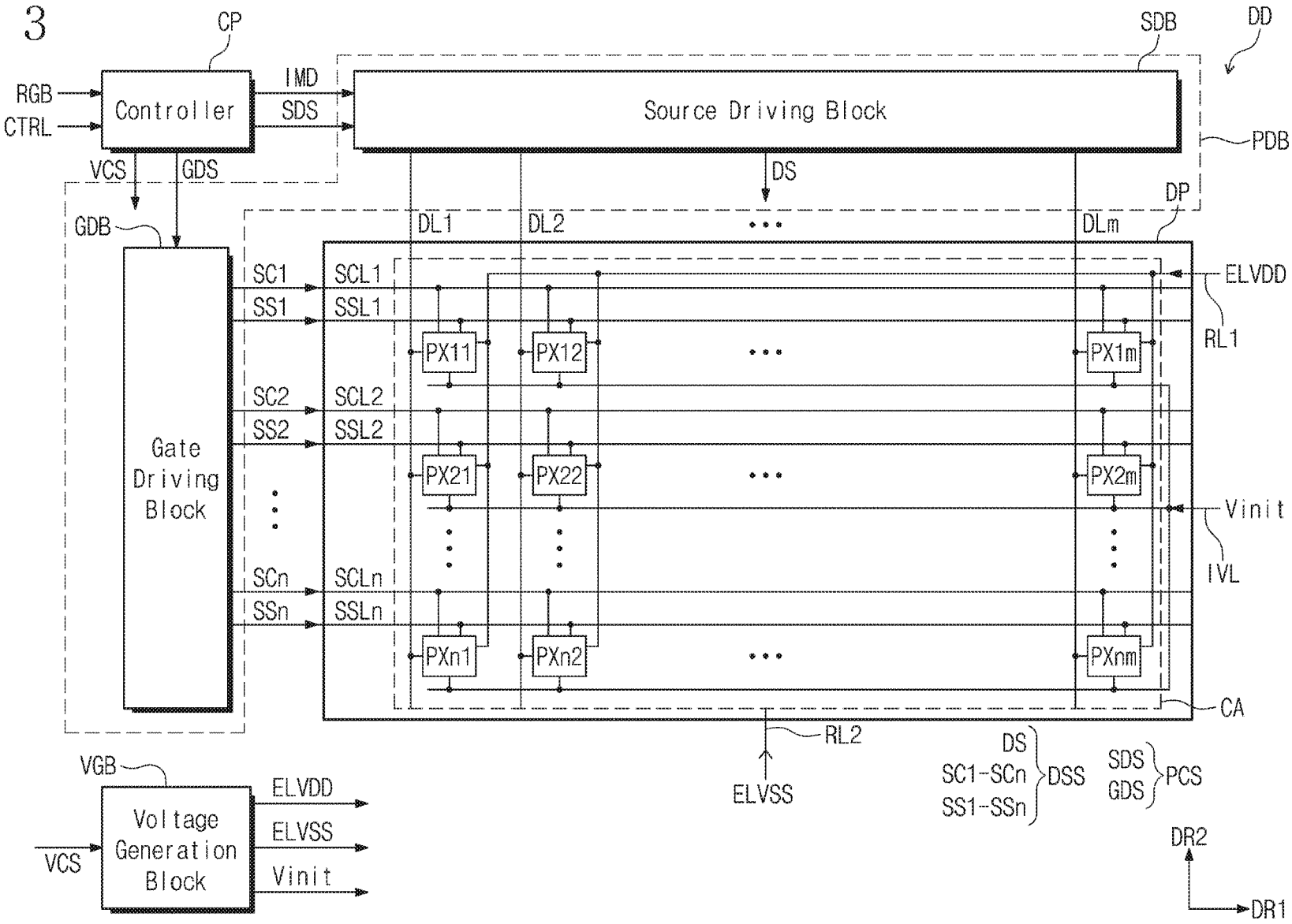
FIG. 3 illustrates an embodiment of a display device.

FIG. 3 is a block diagram showing the display device DD according to an embodiment. The display device DD may include the display panel DP, a controller CP, a panel driving block PDB, and a voltage generation block VGB. As an example, the panel driving block PDB may include a source driving block SDB and a gate driving block GDB.

The controller CP may receive image signals RGB and an external control signal CTRL, and may convert a data format of the image signals RGB to a data format corresponding to an interface between the source driving block SDB and the controller CP to generate image data IMD. The controller CP may generate a first control signal PCS and a second control signal VCS based on the image signals RGB and the external control signal CTRL. The first control signal PCS may include a source control signal SDS and a gate control signal GDS. The external control signal CTRL may include a vertical synchronization signal Vsync (e.g., refer to FIG. 9), a horizontal synchronization signal, a main clock, and/or other signals.

The controller CP may transmit the image data IMD and the first control signal PCS to the panel driving block PDB. The panel driving block PDB may generate a driving signal DSS to drive the display panel DP based on the image data IMD and the first control signal PCS. As an example, the driving signal DSS may include a data signal DS, scan signals SC1 to SCn, and initialization signals SS1 to SSn.

For example, the source driving block SDB may receive the image data IMD and the source control signal SDS from the controller CP. The source control signal SDS may include a horizontal start signal starting an operation of the source driving block SDB. The source driving block SDB may generate the data signal DS based on the image data IMD in response to the source control signal SDS. The source driving block SDB may output the data signal DS to a plurality of data lines DL1 to DLm in a manner, for example, described in greater detail below. The data signal DS may be an analog voltage corresponding to a grayscale value of the image data IMD.

The gate driving block GDB may receive the gate control signal GDS from the controller CP. The gate control signal GDS may include a vertical start signal starting an operation of the gate driving block GDB and a scan clock signal determining an output timing of the scan signals SC1 to SCn and the initialization signals SS1 to SSn. The gate driving block GDB may generate the scan signals SC1 to SCn and the initialization signals SS1 to SSn based on the gate control signal GDS. The gate driving block GDB may sequentially output the scan signals SC1 to SCn to a plurality of scan lines SCL1 to SCLn (in a manner, for example, described in greater detail below) and may sequentially output the initialization signals SS1 to SSn to a plurality of initialization lines SSL1 to SSLn described later.

The voltage generation block VGB may receive the second control signal VCS from the controller CP and may generate voltages for operating the display panel DP. As an example, the voltage generation block VGB may generate a first driving voltage ELVDD, a second driving voltage ELVSS, and an initialization voltage Vinit. The voltage generation block VGB may operate in response to a control of the controller CP. As an example, the voltage generation block VGB may change a voltage level of the first driving voltage ELVDD based on the second control signal VCS. As an example, the voltage level of the first driving voltage ELVDD may be greater than a voltage level of the second driving voltage ELVSS. As an example, the voltage level of the first driving voltage ELVDD may be within a predetermined range, e.g., from about 20V to about 30V. The initialization voltage Vinit may have a voltage level less than the voltage level of the second driving voltage ELVSS. As an example, the voltage level of the initialization voltage Vinit may be within a range from about 1V to about 9V.

As an example, the display panel DP may include the scan lines SCL1 to SCLn, the initialization lines SSL1 to SSLn, the data lines DL1 to DLm, and the pixels PX11 to PXnm. The scan lines SCL1 to SCLn and the initialization lines SSL1 to SSLn may extend in the first direction DR1 from the gate driving block GDB and may be arranged in the second direction DR2 to be spaced apart from each other. The data lines DL1 to DLm may extend in a direction opposite to the second direction DR2 from the source driving block SDB and may be arranged in the first direction DR1 to be spaced apart from each other.

Each of the pixels PX11 to PXnm may be electrically connected to a corresponding scan line among the scan lines SCL1 to SCLn and a corresponding initialization line among the initialization lines SSL1 to SSLn. In addition, each of the pixels PX11 to PXnm may be electrically connected to a corresponding data line among the data lines DL1 to DLm.

Each of the pixels PX11 to PXnm may be electrically connected to a first power line RL1, a second power line RL2, and an initialization power line IVL. The first power line RL1 may receive the first driving voltage ELVDD from the voltage generation block VGB. The second power line RL2 may receive the second driving voltage ELVSS from the voltage generation block VGB. The initialization power line IVL may receive the initialization voltage Vinit from the voltage generation block VGB. As an example, the pixels PX11 to PXnm may include a plurality of groups including organic light emitting diodes emitting color lights different from each other. For instance, the pixels PX11 to PXnm may include red pixels emitting a red color light, green pixels emitting a green color light, and blue pixels emitting a blue color light. The organic light emitting diode of the red pixel, the organic light emitting diode of the green pixel, and the organic light emitting diode of the blue pixel may include different light emitting materials from each other. The organic light emitting diode included in each pixel PX11 to PXnm may include a cathode CA electrically connected to the second power line RL2, and may receive the second driving voltage ELVSS from the voltage generation block VGB. In one embodiment, cathodes CA in the pixels PX11 to PXnm may be integrally formed with each other to form a common cathode. As an example, the common cathode may be formed to overlap two or more pixels.

Figure 4:
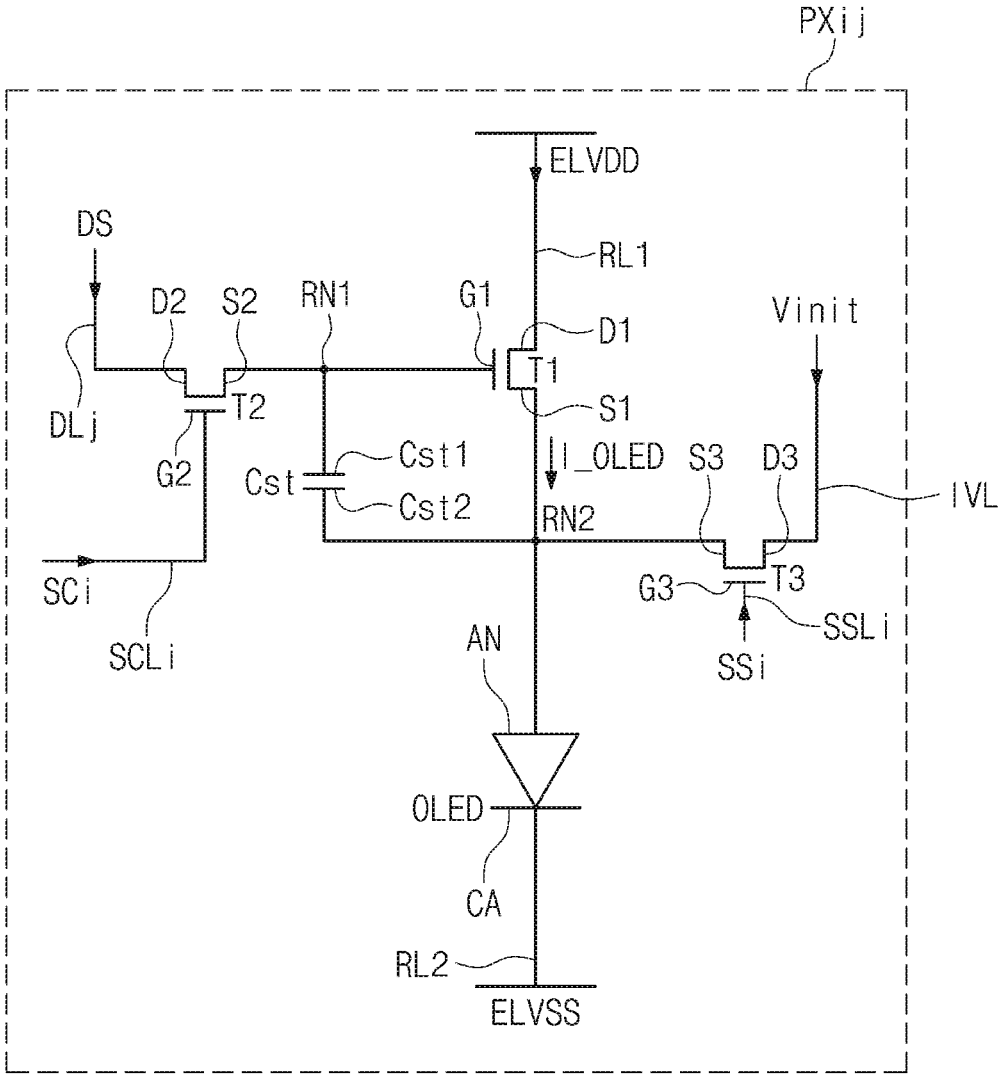
FIG. 4 illustrates an embodiment of a pixel.

FIG. 4 is an equivalent circuit diagram showing an embodiment of a pixel PXij which may represent one or more of the pixels in the display device DD. The pixel PXij is connected to an i-th scan line SCLi among the scan lines SCL1 to SCLn, an i-th initialization line SSLi among the initialization lines SSL1 to SSLn, and a j-th data line DLj among the data lines DL1 to DLm.

In one embodiment, the pixel PXij may include first, second, and third transistors T1, T2, and T3, a capacitor Cst, and a light emitting diode OLED. In the present embodiment, each of the first, second, and third transistors T1, T2, and T3 will be described as an N-type transistor, however the present disclosure should not be limited thereto. All or a portion of the first, second, and third transistors T1, T2, and T3 may be implemented as a P-type transistors or a combination of P-type and N-type transistors in other embodiments. In the present disclosure, the expression "a transistor is connected to a signal line" may include where one electrode of a source electrode, a drain electrode, and a gate electrode of the transistor is provided integrally with the signal line or connected to the signal line via a connection electrode. In addition, the expression "a transistor is electrically connected to another transistor" may include where one electrode of a source electrode, a drain electrode, and a gate electrode of the transistor is provided integrally with one electrode of a source electrode, a drain electrode, a gate electrode of another transistor or connected to one electrode of the source electrode, the drain electrode, the gate electrode of another transistor via a connection electrode.

In the present embodiment, the first transistor T1 may be a driving transistor, the second transistor T2 may be a switching transistor, and the third transistor T3 may be an initialization transistor. Each of the first to third transistors T1 to T3 may include a first electrode, a second electrode, and a control electrode, where the first electrode may be referred to as a source electrode, the second electrode may be referred to as a drain electrode, and the control electrode may be referred to as a gate electrode, but a different arrangement of electrodes may be implemented in another embodiment.

The first transistor T1 may be connected between the first power line RL1 and the light emitting diode OLED. The first transistor T1 may include a source electrode S1 electrically connected to an anode AN of the light emitting diode OLED, a drain electrode D1 electrically connected to the first power line RL1, and a gate electrode G1 electrically connected to a first reference node RN1. The first reference node RN1 may be electrically connected to a source electrode S2 of the second transistor T2. As an example, the first driving voltage ELVDD may be applied to the drain electrode D1 of the first transistor T1 via the first power line RL1.

The second transistor T2 may be connected between the j-th data line DLj and the gate electrode G1 of the first transistor T1. The second transistor T2 may include a source electrode S2 electrically connected to the gate electrode G1 of the first transistor T1, a drain electrode D2 electrically connected to the j-th data line DLj, and a gate electrode G2 electrically connected to the i-th scan line SCLi. As an example, an i-th scan signal SCi may be applied to the gate electrode G2 of the second transistor T2 via the i-th scan line SCLi, and a data signal DS may be applied to the drain electrode D2 of the second transistor T2 via the j-th data line DLj.

The third transistor T3 may be connected between a second reference node RN2 and the initialization power line IVL. The third transistor T3 may include a source electrode S3 electrically connected to the second reference node RN2. The second reference node RN2 may be electrically connected to the source electrode S1 of the first transistor T1. In addition, the second reference node RN2 may be electrically connected to the anode AN of the light emitting diode OLED. A drain electrode D3 of the third transistor T3 may be electrically connected to the initialization power line IVL, and a gate electrode G3 of the third transistor T3 may be electrically connected to the i-th initialization line SSLi. As an example, an i-th initialization signal SSi may be applied to the gate electrode G3 of the third transistor T3 via the i-th initialization line SSLi, and the initialization voltage Vinit may be applied to the drain electrode D3 of the third transistor T3 via the initialization power line IVL.

The light emitting diode OLED may be connected between the second reference node RN2 and the second power line RL2. The anode AN of the light emitting diode OLED may be electrically connected to the second reference node RN2. The cathode CA of the light emitting diode OLED may be electrically connected to the second power line RL2.

The capacitor Cst may be connected between the first reference node RN1 and the second reference node RN2. A first electrode Cst1 of the capacitor Cst may be electrically connected to the first reference node RN1, and a second electrode Cst2 of the capacitor Cst may be electrically connected to the second reference node RN2.

Referring to FIG. 3, the gate driving block GDB may sequentially apply the scan signals SC1 to SCn and the initialization signals SS1 to SSn to the display panel DP. Each of the scan signals SC1 to SCn and the initialization signals SS1 to SSn may have a high level for some sections and may have a low level for some sections. In this case, N-type transistors are turned on when corresponding signals have a high level, and P-type transistors are turned on when corresponding signals have a low level. Hereinafter, the pixel PXij including the N-type first, second, and third transistors T1, T2, and T3 shown in FIG. 4 will be described as a representative example.

When the i-th initialization signal SSi has the high level, the third transistor T3 may be turned on. When the third transistor T3 is turned on, the initialization voltage Vinit may be transmitted to the second reference node RN2 via the third transistor T3. Accordingly, the second reference node RN2 may be initialized to the initialization voltage Vinit, and the source electrode S1 of the first transistor T1 and the anode AN of the light emitting diode OLED, which are electrically connected to the second reference node RN2, may be initialized to the initialization voltage Vinit.

When the i-th scan signal SCi has the high level, the second transistor T2 may be turned on. When the second transistor T2 is turned on, the data signal DS may be transmitted to the first reference node RN1 via the second transistor T2. Accordingly, the data signal DS may be applied to the gate electrode G1 of the first transistor T1 and the first electrode Cst1 of the capacitor Cst, which are electrically connected to the first reference node RN1. When the data signal DS is applied to the gate electrode G1 of the first transistor T1, the first transistor T1 may be turned on.

In one embodiment, a period during which the i-th initialization signal SSi has the high level may overlap a period during which the i-th scan signal SCi has the high level. In this case, the data signal DS and the initialization voltage Vinit may be applied to respective ends of the capacitor Cst, and the capacitor Cst may be charged with electric charges corresponding to a voltage difference DS-Vinit between the ends thereof.

The second driving voltage ELVSS may be applied to the cathode CA of the light emitting diode OLED. Accordingly, when the i-th initialization signal SSi has the high level and the initialization voltage Vinit having the voltage level lower than the voltage level of the second driving voltage ELVSS is applied to the anode AN of the light emitting diode OLED, no current may flow through the light emitting diode OLED.

When the i-th scan signal SCi has the low level, the second transistor T2 may be turned off. When i-th initialization signal SSi has the low level, the third transistor T3 may be turned off. As an example, a period during which the i-th scan signal SCi has the low level may overlap a period during which the i-th initialization signal SSi has the low level.

Although the second transistor T2 is turned off in response to the i-th scan signal SCi having the low level, the first transistor T1 may maintain the turn-on state by the electric charges charged in the capacitor Cst. Accordingly, a driving current I_OLED may flow through the first transistor T1. Due to the driving current I_OLED flowing in through the first transistor T1, a voltage level of the anode AN of the light emitting diode OLED may gradually increase. When the voltage level of the anode AN becomes higher than the voltage level of the cathode CA, the driving current I_OLED may flow toward the light emitting diode OLED, and the light emitting diode OLED may emit a light. In this case, although the voltage level of the second reference node RN2 increases, the voltage level of the first reference node RN1 may increase due to a coupling effect of the capacitor Cst. Thus, a level of the driving current I_OLED flowing through the first transistor T1 may be maintained.

As an example, according to a current-voltage relationship of the first transistor T1, the level of the driving current I_OLED may be proportional to the voltage level of the data signal DS applied to the gate electrode G1 of the first transistor T1 when the voltage level of the first driving voltage ELVDD applied to the drain electrode D1 of the first transistor T1 is greater than a saturation voltage level of the first transistor T1. The saturation voltage level of the first transistor T1 may be a voltage level of a point at which the driving current I_OLED is uniformly maintained, even when the level of the voltage applied to the drain electrode D1 of the first transistor T1 increases.

On the other hand, when the voltage level of the first driving voltage ELVDD applied to the drain electrode D1 of the first transistor T1 is less than the saturation voltage level, the level of the driving current I_OLED flowing through the first transistor T1 may be determined by the voltage level of the first driving voltage ELVDD and the voltage level of the data signal DS.

Accordingly, although the data signal DS with the uniform voltage level is applied to the first transistor T1, the level of the driving current I_OLED may be changed depending on the voltage level of the first driving voltage ELVDD. Thus, emission intensity of the light emitting diode OLED may be changed.

The saturation voltage level of the first transistor T1 may be changed depending on the grayscale of the image IM displayed through the display panel DP (e.g., refer to FIG. 1). For example, in a case where the image IM displayed through the display panel DP has a low grayscale (e.g., in a first predetermined range), the saturation voltage level of the first transistor T1 may decrease. In a case where the image IM displayed through the display panel DP has a high grayscale (e.g., in a second predetermined range greater than the first predetermined range), the saturation voltage level of the first transistor T1 may increase. This is because the level of the driving current I_OLED may be increased to display the image IM with high grayscale, and a voltage drop generated in an internal resistance of the display panel DP may increase as the level of the driving current I_OLED increases.

When the level of the driving current I_OLED flowing through the light emitting diode OLED is uniform and the voltage level of the first driving voltage ELVDD applied to the display panel DP decreases, power consumption of the display panel DP may be reduced. Accordingly, in a case where the image IM displayed through the display panel DP has a low grayscale, the power consumption of the display panel DP may be reduced by lowering the first driving voltage ELVDD by the saturation voltage level of the first transistor T1.

In one embodiment, the pixel PXij may include an additional capacitor connected between the second reference node RN2 and the second power line RL2. A first electrode of the additional capacitor may be electrically connected to the second reference node RN2, and a second electrode of the additional capacitor may be electrically connected to the second power line RL2.

Figure 5:
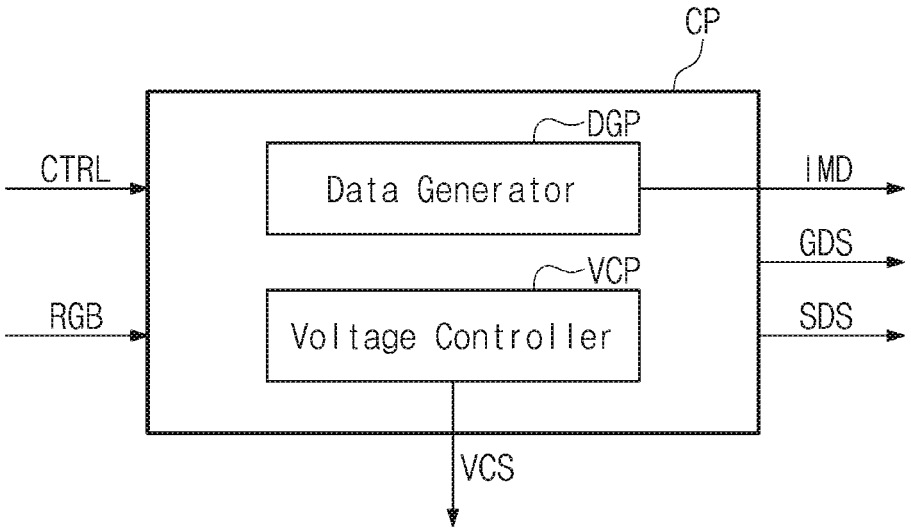
FIG. 5 illustrates an embodiment of a controller.
Figure 6:
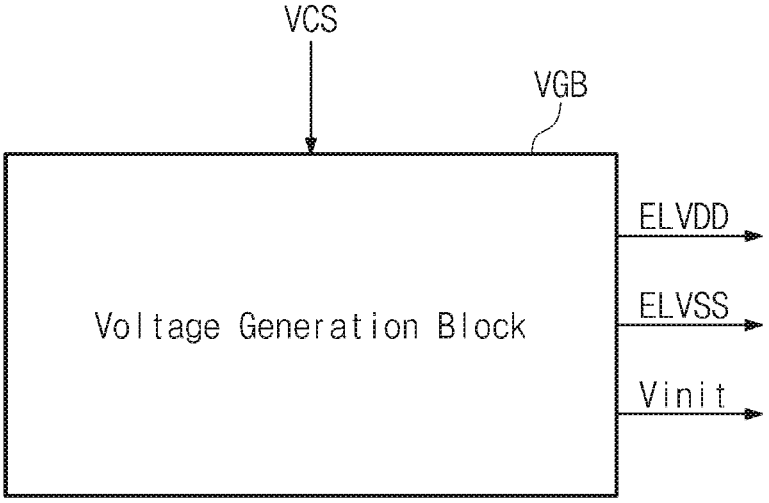
FIG. 6 illustrates an embodiment of a voltage generation block.
Figure 7:
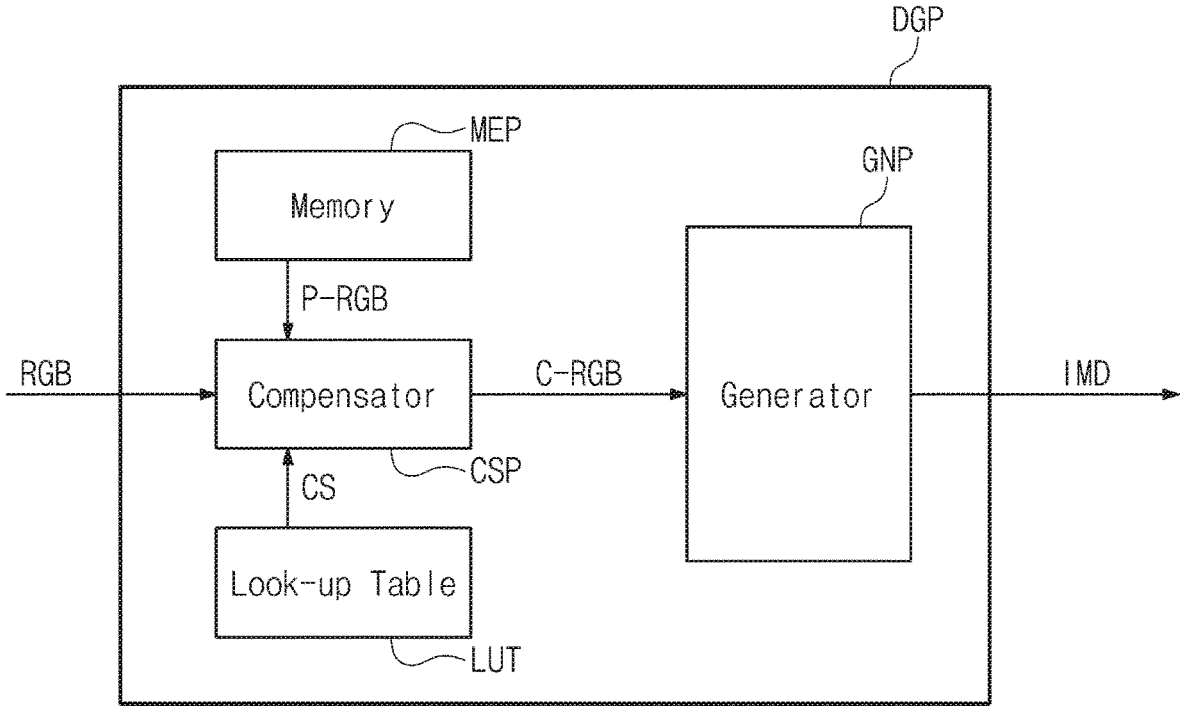
FIG. 7 illustrates an embodiment of a data generator.
Figure 8:
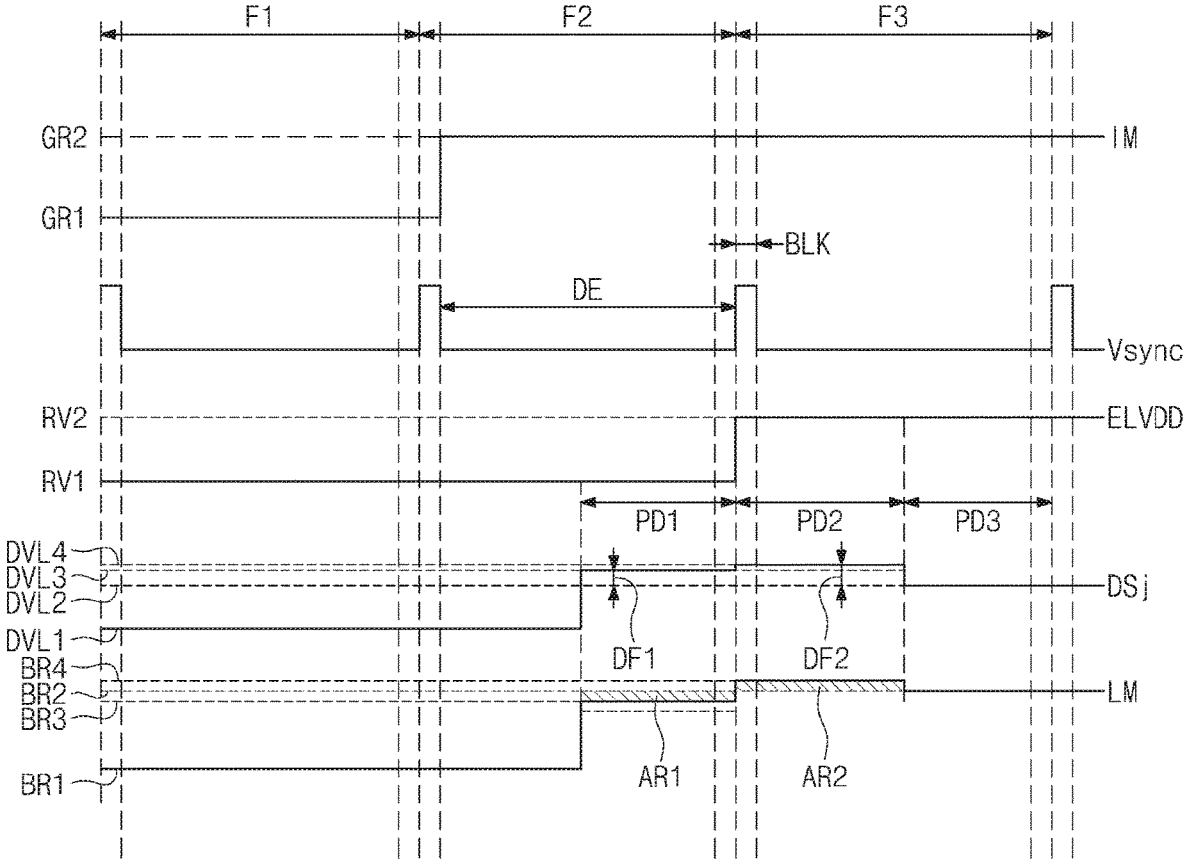
FIG. 8 illustrates an embodiment of driving voltage and data signal waveforms.

FIG. 5 is a block diagram showing an embodiment of the controller CP. FIG. 6 is a block diagram explaining operation of the voltage generation block VGB according to an embodiment. FIG. 7 is a block diagram of an embodiment of a data generator DGP. FIG. 8 illustrates an embodiment of a waveform diagram explaining a voltage level of a driving voltage and a voltage level of a data signal as a function of a grayscale of an image. In FIGS. 5 to 8, like reference numerals may denote like elements and signals as in FIG. 3.

Referring to FIGS. 5 to 8, the controller CP may include the data generator DGP and a voltage controller VCP. The voltage controller VCP may generate the second control signal VCS based on the image signals RGB and the external control signal CTRL. The second control signal VCS may include information to change the voltage level of the first driving voltage ELVDD.

The image IM (e.g., refer to FIG. 1) displayed through the display panel DP (e.g., refer to FIG. 2) may include a first image displayed in a first frame F1, a second image displayed in a second frame F2, and a third image displayed in a third frame F3. The first image may have a first grayscale GR1, and each of the second image and the third image may have a second grayscale GR2 different from (e.g., greater than) the first grayscale GR1.

As an example, in a case where the image displayed through the display panel DP in the second frame F2 is converted from the first image to the second image, the voltage level of the first driving voltage ELVDD may be changed to a second voltage level RV2 from a first voltage level RV1 in a period that does not overlap a data write-in period DE of the second frame F2. As an example, the voltage level of the first driving voltage ELVDD may be changed in a blank period BLK of the third frame F3. As an example, the second voltage level RV2 may be greater than the first voltage level RV1. However, as an example, when the first grayscale GR1 is greater than the second grayscale GR2, the second voltage level RV2 may be less than the first voltage level RV1.

The voltage controller VCP may generate the second control signal VCS based on the image signals RGB to change the voltage level of the first driving voltage ELVDD in the third frame F3. For example, the voltage level of the first driving voltage ELVDD may be changed according to the second grayscale GR2 of the second image displayed in the second frame F2. The change in the voltage level of the first driving voltage ELVDD may occur in the third frame F3 following the second frame F2.

In one embodiment, the change in the voltage level of the first driving voltage ELVDD may occur in the blank period BLK of the vertical synchronization signal Vsync that distinguishes the second frame F2 from the third frame F3. The second control signal VCS may include timing information that allows the voltage generation block VGB to change the voltage level of the first driving voltage ELVDD in the blank period BLK.

The voltage generation block VGB may receive the second control signal VCS from the voltage controller VCP and may change the voltage level of the first driving voltage ELVDD based on the second control signal VCS.

Referring to FIGS. 7 and 8, the data generator DGP may include a memory MEP, a compensator CSP, a look-up table LUT, and a generator GNP. For convenience of explanation, the data generator DGP that generates image data IMD corresponding to the second frame F2 among the image data IMD will be described as a representative example.

The memory MEP may store image signals P-RGB corresponding to the image displayed through the display panel DP in the first frame F1 located immediately before the second frame F2. The look-up table LUT may store a correction table generated based on a difference in a grayscale value between the image signals P-RGB of the first frame F1 and the image signals RGB of the second frame F2. As an example, the correction table may be generated based on not only the grayscale value difference of the image signals P-RGB and RGB of the first and second frames F1 and F2, but also the change in voltage level of the first driving voltage ELVDD in response to the change in the grayscale value of the image signals P-RGB and RGB of the first and second frames F1 and F2. As an example, the image signals P-RGB of the first frame F1 may be referred to as first image signals, and the image signals RGB of the second frame F2 may be referred to as second image signals.

The compensator CSP may receive the image signals P-RGB of the first frame F1 from the memory MEP and may receive the image signals RGB corresponding to the image displayed through the display panel DP from the outside in the second frame F2. The compensator CSP may read out a correction signal CS corresponding to the difference in the grayscale value between the image signals P-RGB of the first frame F1 and the image signals RGB of the second frame F2 from the correction table of the look-up table LUT.

The compensator CSP may generate correction image signals C-RGB based on the correction signal CS and the image signals RGB of the second frame F2. As the difference in the grayscale value between the image signals P-RGB and RGB of the first and second frames F1 and F2 increases, a degree to which the grayscale value of the correction image signals C-RGB is corrected from the grayscale value of the image signals RGB of the second frame F2 may increase. In addition, as a degree of the change in the voltage level of the first driving voltage ELVDD increases in response to the change in the grayscale value of the image signals P-RGB and RGB of the first and second frames F1 and F2 increases, a degree to which the grayscale value of the correction image signals C-RGB is corrected from the grayscale value of the image signals RGB of the second frame F2 may increase.

The generator GNP may receive correction image signals C-RGB from the compensator CSP and may generate the image data IMD corresponding to the second frame F2 based on the correction image signals C-RGB.

The source driving block SDB (e.g., refer to FIG. 3) may generate the data signal DS based on the image data IMD provided from the generator GNP in response to the source control signal SDS from the controller CP.

Referring to FIG. 8, the third frame F3, the second frame F2 located immediately before the third frame F3, and the first frame F1 located immediately before the second frame F2 are shown. In addition, the grayscale value of the image IM displayed through the display panel DP (e.g., refer to FIG. 1), the vertical synchronization signal Vsync, the first driving voltage ELVDD, a voltage level of a j-th data signal DSj applied to the pixel PXij (e.g., refer to FIG. 4), and a brightness LM of the pixel PXij during the first, second, and third frames F1, F2, and F3 are shown.

The vertical synchronization signal Vsync may include the data write-in period DE and the blank period BLK. The data write-in period DE may be a period in which the j-th data signal DSj is written in the display panel DP through the data lines DL1 to DLm (e.g., refer to FIG. 3). The blank period BLK may be a period in which the j-th data signal DSj is not written in the display panel DP through the data lines DL1 to DLm (e.g., refer to FIG. 3). As an example, the first transistor T1 (e.g., refer to FIG. 4) may be turned off in the blank period BLK, and the j-th data signal DSj provided through the data lines DL1 to DLm may not be applied to the pixel PXij.

The voltage level of the first driving voltage ELVDD may be changed in a period that does not overlap the data write-in period DE of the vertical synchronization signal Vsync.

The voltage level of the j-th data signal DSj may be changed according to the grayscale value of the image IM displayed through the display panel DP. For example, when the first image is displayed through the display panel DP, the j-th data signal DSj having a first data level DVL1 may be applied to the pixel PXij to display the first grayscale GR1. When the second image is displayed through the display panel DP, the j-th data signal DSj having a second data level DVL2 may be applied to the pixel PXij to display the second grayscale GR2. However, the voltage level of the j-th data signal DSj may be changed before and after the period in which the voltage level of the first driving voltage ELVDD is changed according to the grayscale value of the image IM displayed through the display panel DP. An embodiment will be described with the brightness LM of the pixel PXij.

In one embodiment, the brightness LM of the pixel PXij may be changed according to the grayscale value of the image IM displayed through the display panel DP. For example, when the first image is displayed through the display panel DP, the pixel PXij may have a first brightness value BR1 corresponding to the first grayscale value GR1. When the second image is displayed through the display panel DP, the pixel PXij may have a second brightness value BR2 corresponding to the second grayscale value GR2.

A first period PD1 may be included in the second frame F2, and a second period PD2 and a third period PD3 may be included in the third frame F3 to explain embodiments of the present disclosure. In the second frame F2, the first period PD1 may include a point, at which the j-th data signal DSj having a third data level DVL3 is applied to the pixel PXij to display the second grayscale value GR2, to a point at which the voltage level of the first driving voltage ELVDD is changed from the first voltage level RV1 to the second voltage level RV2.

In the third frame F3, the second period PD2 may include a point, at which the voltage level of the first driving voltage ELVDD is changed to the second voltage level RV2, to a point at which the j-th data signal DSj having the second data level DVL2 is applied to the pixel PXij to display the second grayscale value GR2.

In the third frame F3, the third period PD3 includes a point, at which the j-th data signal DSj having the second data level DVL2 is applied to the pixel PXij, to a point at which the third frame F3 is finished.

As an example, widths of the first period PD1, the second period PD2, and the third period PD3 may be changed depending on the position of the pixel PXij. This will be described with reference to FIGS. 11A to 12B.

As an example, a third brightness value BR3 of the pixel PXij of the first period PD1 may be less than a second brightness value BR2 of the pixel PXij in the third period PD3. This is because the first voltage level RV1 of the first driving voltage ELVDD in the first period PD1 is less than the second voltage level RV2 of the first driving voltage ELVDD in the second period PD2. The brightness LM of the pixel PXij in the first period PD1 may be lowered by a first area AR1 compared with the brightness LM in the third period PD3.

As an example, a fourth brightness value BR4 of the pixel PXij in the second period PD2 may be greater than the second brightness value BR2 of the pixel PXij in the third period PD3. When the voltage level of the first driving voltage ELVDD is changed from the first voltage level RV1 to the second voltage level RV2 at a boundary between the first period PD1 and the second period PD2, an electric potential of the first reference node RN1 may be changed due to a coupling effect of a parasitic capacitor formed between the first power line RL1 (e.g., refer to FIG. 4) and the capacitor Cst. Due to the change of the first reference node RN1, the j-th data signal DSj having the third data level DVL3 and applied to the pixel PXij in the first period PD1 may be changed to a fourth data level DVL4. Accordingly, the brightness LM of the pixel PXij of the second period PD2 may increase by a second area AR2 compared with the brightness LM in the third period PD3.

As an example, the pixel PXij may have the second brightness value BR2 in the third period PD3. In the third period PD3, the first driving voltage ELVDD having the second voltage level RV2 and the j-th data signal DSj having the second data level DVL2 may be applied to the pixel PXij.

As an example, the third data level DVL3 may be greater than the second data level DVL2. Since the first driving voltage ELVDD having the first voltage level RV1 less than the second voltage level RV2 of the first driving voltage ELVDD in the third period PD3 is applied in the first period PD1, the j-th data signal DSj having the third data level DVL3 greater than the second data level DVL2 in the third period PD3 may be applied to the pixel PXij in the first period PD1. Since there is a difference between the grayscale value GR2 of the image signals RGB applied in the second frame F2 in which the first period PD1 is included and the grayscale value GR1 of the image signals P-RGB applied in the first frame F1, the compensator CSP may read out the correction signal CS from the look-up table LUT (e.g., refer to FIG. 7). The compensator CSP may generate the correction image signals C-RGB based on the correction signal CS and the image signals RGB of the second frame F2.

Since, in one embodiment, there is no difference between the grayscale value GR2 of the image signals RGB applied in the second frame F2 and the grayscale value GR3 of the image signals applied in the third frame F3 in the third period PD3, correction by the compensator CSP may not occur. Accordingly, the third data level DVL3 in the first period PD1 may be greater than the second data level DVL2 in the third period PD3.

As an example, the fourth data level DVL4 may be greater than the third data level DVL3. This is because the voltage level of the first driving voltage ELVDD at the boundary between the first period PD1 and the second period PD2 increases and the j-th data signal DSj applied to the pixel PXij increases due to the coupling phenomenon.

According to one or more embodiments, as the first difference DF1 between the third data level DVL3 and the second data level DVL2 increases, the second difference DF2 between the fourth data level DVL4 and the second data level DVL2 may increase. As the first difference DF1 increases, the first area AR1 in the first period PD1 may decrease and the second area AR2 in the second period PD2 may increase.

A number of cases will now be discussed. A first case may correspond to where the controller CP (e.g., refer to FIG. 7) generates the image data based on only the image signals RGB applied in the second frame F2 and applies the j-th data signal DSj generated based on the image data to the pixel PXij. A second case may correspond to where the controller CP generates the correction image signals C-RGB using the compensator CSP, generates the image data IMD based on the correction image signals C-RGB, and applies the j-th data signal DSj generated based on the generated image data IMD to the pixel PXij.

According to one or more embodiments, the image data IMD and the j-th data signal DSj may be generated as the second case. The voltage level of the j-th data signal DSj of the first period PD1 in the second case may be greater than the voltage level of the j-th data signal DSj of the first period PD1 in the first case. Accordingly, when the sizes of the first area AR1 and second area AR2 are adjusted in accordance with one or more embodiments, it is possible to prevent a change in the brightness LM of the pixel PXij (caused by the change in voltage level of the first driving voltage ELVDD) from being viewed by a user.

Figure 9:
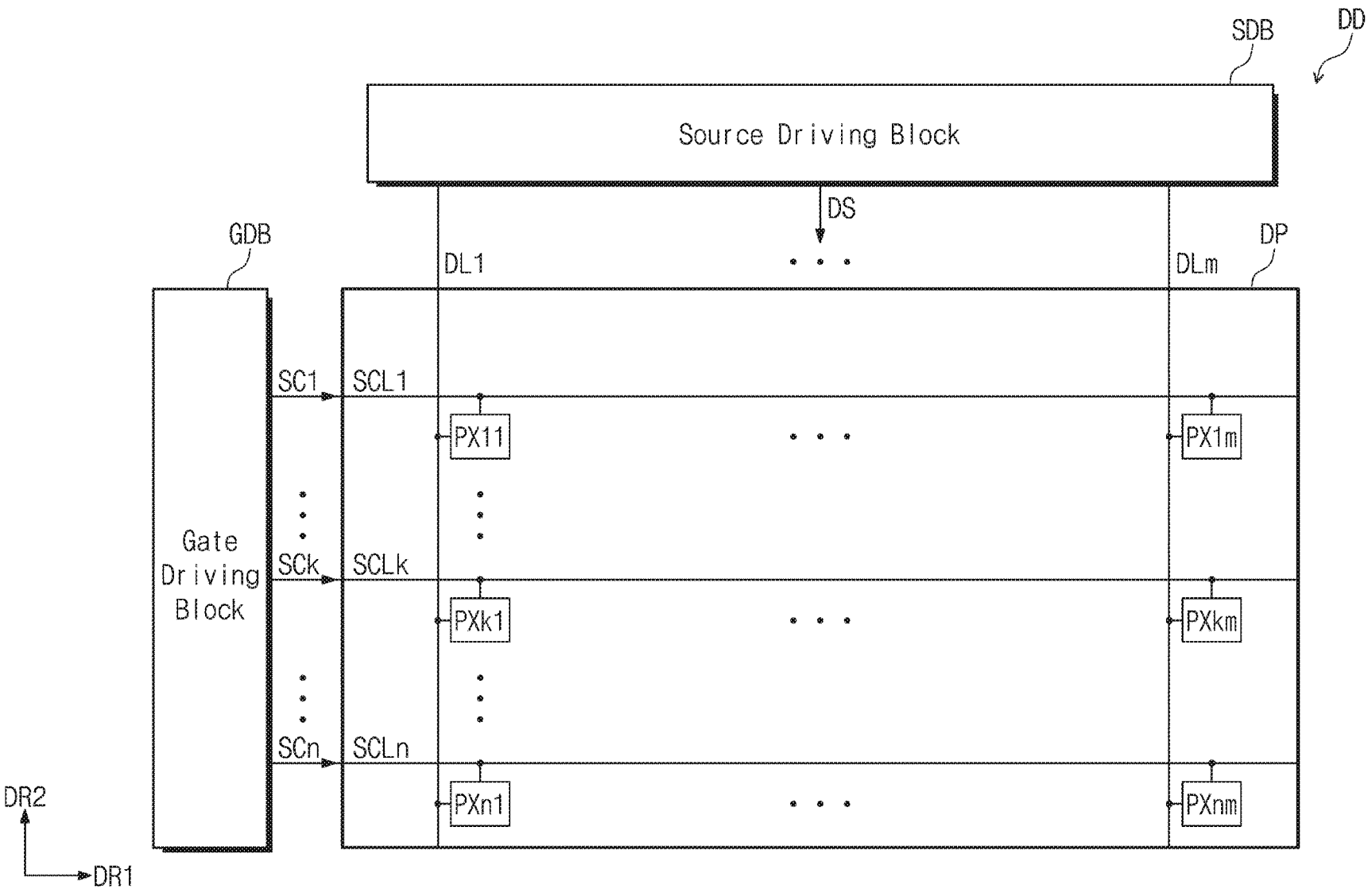
FIG. 9 illustrates an embodiment of a display device.
Figure 10:
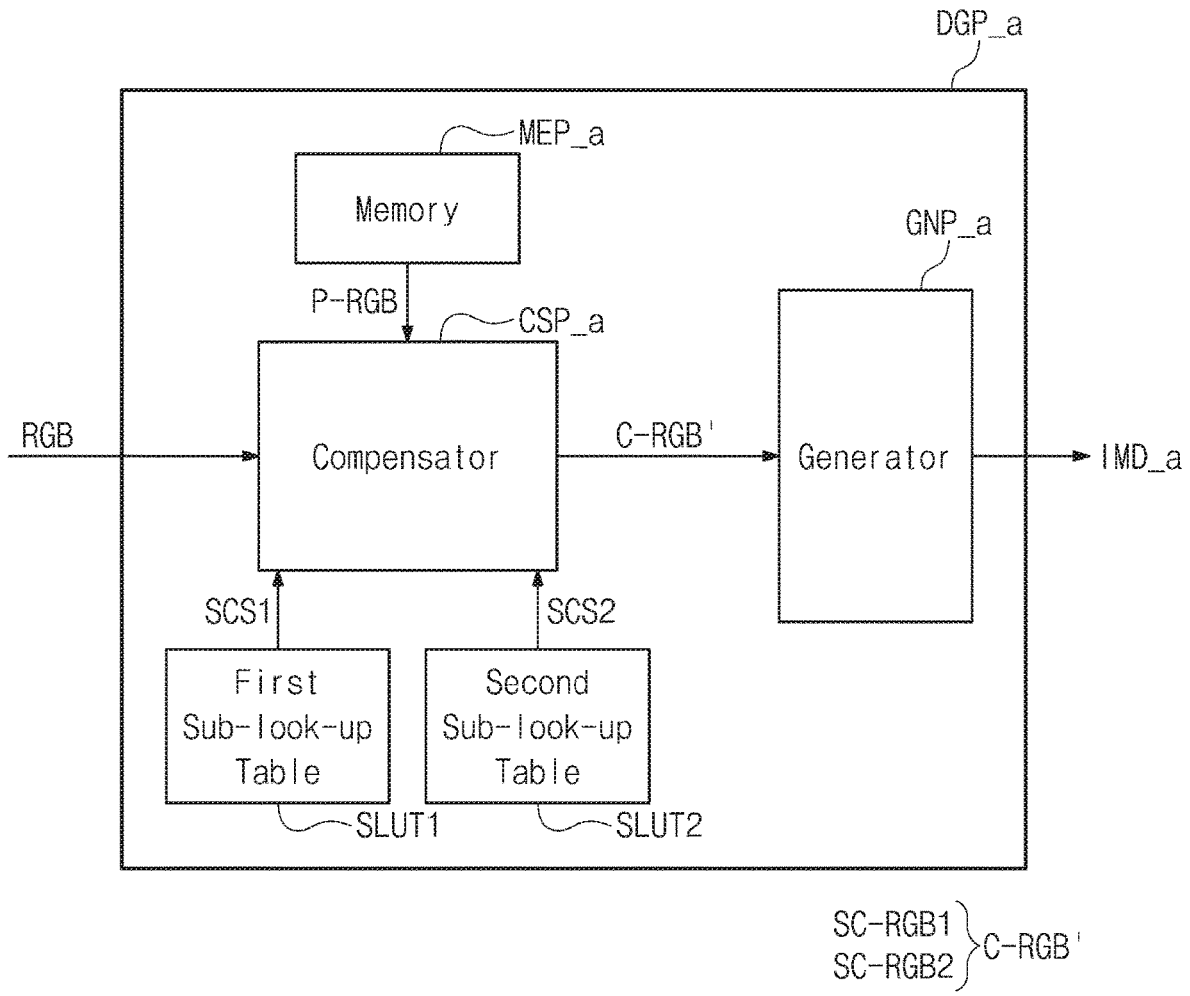
FIG. 10 illustrates an embodiment of a data generator.

FIG. 9 is a block diagram explaining a variation in voltage level of the driving voltage and a variation in voltage level of the data signal as a function of pixel position according to an embodiment. FIG. 10 is a block diagram explaining a configuration and an operation of a data generator DGP-a according to an embodiment. In FIGS. 9 and 10, like reference numerals denote like elements and signals as in FIGS. 3 and 7. Moreover, for the convenience of explanation, FIG. 9 shows only the display panel DP, the source driving block SDB, and the gate driving block GDB of the display device DD. As an example, the display device DD may further include the controller CP and the voltage generation block VGB as shown in FIG. 3.

The gate driving block GDB may sequentially output the scan signals SC1 to SCn to the scan lines SCL1 to SCLn of the display panel DP during one frame in which the image IM (e.g., refer to FIG. 1) is displayed through the display panel DP. The data signal DS output to the display panel DP from the source driving block SDB via the data lines DL1 to DLm may be applied to each of the pixels PX11 to PXnm in accordance with timing of the scan signals SC1 to SCn output from the gate driving block GDB.

As an example, in one frame, the timing at which the gate driving block GDB outputs a first scan signal SC1 to the display panel DP via a first scan line SCL1 may precede the timing at which a k-th scan signal SCk is output to the display panel DP through a k-th scan line SCLk. In one frame, the timing at which the gate driving block GDB outputs the k-th scan signal SCk to the display panel DP via the k-th scan line SCLk may precede the timing at which an n-th scan signal SCn is output to the display panel DP via an n-th scan line SCLn.

Accordingly, in one frame, the timing at which the source driving block SDB applies the data signal DS to a first pixel PX11, which is connected to the first scan line SCL1, via a first data line DL1 may precede the timing at which the data signal DS is applied to a second pixel PXk1, which is connected to the k-th scan line SCLk, via the first data line DL1. The timing at which the source driving block SDB applies the data signal DS to the second pixel PXk1, which is connected to the k-th scan line SCLk, via the first data line DL1 may precede the timing at which the data signal DS is applied to a third pixel PXn1, which is connected to the n-th scan line SCLn, via the first data line DL1.

FIG. 10 is a block diagram explaining a configuration and operation of the data generator DGP-a according to an embodiment. In FIG. 10, like reference numerals may denote like elements and signals as in FIG. 7. In addition, for the convenience of explanation, among the pixels PX11 to PXnm (e.g., refer to FIG. 9), the first pixel PX11 and the second pixel PXk1, which are connected to the first data line DL1, will be described in detail. Further, the data generator DGP-a will be described as generating the image data IMD in the second frame F2 (e.g., refer to FIG. 11A).

Referring to FIGS. 9 and 10, in a case where the grayscale value of the image IM displayed through the display panel DP is changed in the second frame F2, the voltage level of the first driving voltage ELVDD (e.g., refer to FIG. 11A) may be changed in the third frame F3. As the voltage level of the first driving voltage ELVDD is changed, the brightness of the display panel DP may be changed. As a result, a flicker phenomenon may be recognized by the user. The image signals RGB of the second frame F2 may be corrected by the data generator DGP_a to generate the correction image signals C-RGB', and image data IMD_a may be generated based on the correction image signals C-RGB' to prevent the flicker phenomenon from being recognized by the user. In this case, the timing at which the data signal DS is applied to each of the pixels PX11 to PXnm in one frame may be changed depending on the positions of the pixels PX11 to PXnm. Accordingly, the degree of correction of the image signals RGB using the data generator DGP_a may be changed depending on the positions of the pixels PX11 to PXnm.

The data generator DGP_a may include a first sub-look-up table SLUT1 and a second sub-look-up table SLUT2. The first sub-look-up table SLUT1 may store a first correction table generated by reflecting position information corresponding to the position of the first pixel PX11 to the grayscale value difference between the image signals P-RGB of the first frame F1 and the image signals RGB of the second frame F2. The first correction table may be generated not only based on the position information of the first pixel PX11 and the grayscale value difference of the image signals P-RGB and RGB of the first and second frames F1 and F2, but also based on the voltage level of the first driving voltage ELVDD that is changed in response to the change in grayscale of the image signals P-RGB and RGB of the first and second frames F1 and F2.

A compensator CSP_a may read out from the first correction table a first sub-correction signal SCS1, which corresponds to the difference in grayscale value between image signals corresponding to the first pixel PX11 among the image signals P-RGB in first frame F1 and image signals corresponding to the first pixel PX11 among the image signals RGB of the second frame F2.

The second sub-look-up table SLUT2 may store a second correction table generated by reflecting position information corresponding to a position of the second pixel PXk1 to the grayscale value difference between the image signals P-RGB of the first frame F1 and the image signals RGB of the second frame F2. The second correction table may be generated not only based on the position information of the second pixel PXk1 and the grayscale difference of the image signals P-RGB and RGB of the first and second frames F1 and F2, but also based on the voltage level of the first driving voltage ELVDD that is changed in response to the change in grayscale of the image signals P-RGB and RGB of the first and second frames F1 and F2.

The compensator CSP_a may read out from the second correction table a second sub-correction signal SCS2, which corresponds to the difference in grayscale value between the image signals corresponding to the second pixel PXk1 among the image signals P-RGB of the first frame F1 and the image signals corresponding to the second pixel PXk1 among the image signals RGB of the second frame F2.

The compensator CSP_a may generate the correction image signals C-RGB' based on the first sub-correction signal SCS1, the second sub-correction signal SCS2, and the image signals RGB of the second frame F2. As an example, the correction image signals C-RGB' may include first sub-correction image signals SC-RGB1 and second sub-correction image signals SC-RGB2.

The compensator CSP_a may generate the first sub-correction image signals SC-RGB1 based on the first sub-correction signal SCS1 and the image signals corresponding to the first pixel PX11 among the image signals RGB of the second frame F2. The compensator CSP_a may generate the second sub-correction image signals SC-RGB2 based on the second sub-correction signal SCS2 and the image signals corresponding to the second pixel PXk1 among the image signals RGB of the second frame F2.

A generator GNP_a may receive the correction image signals C-RGB' from the compensator CSP_a and may generate the image data IMD_a corresponding to the second frame F2 based on the correction image signals C-RGB'.

Figure 11A:
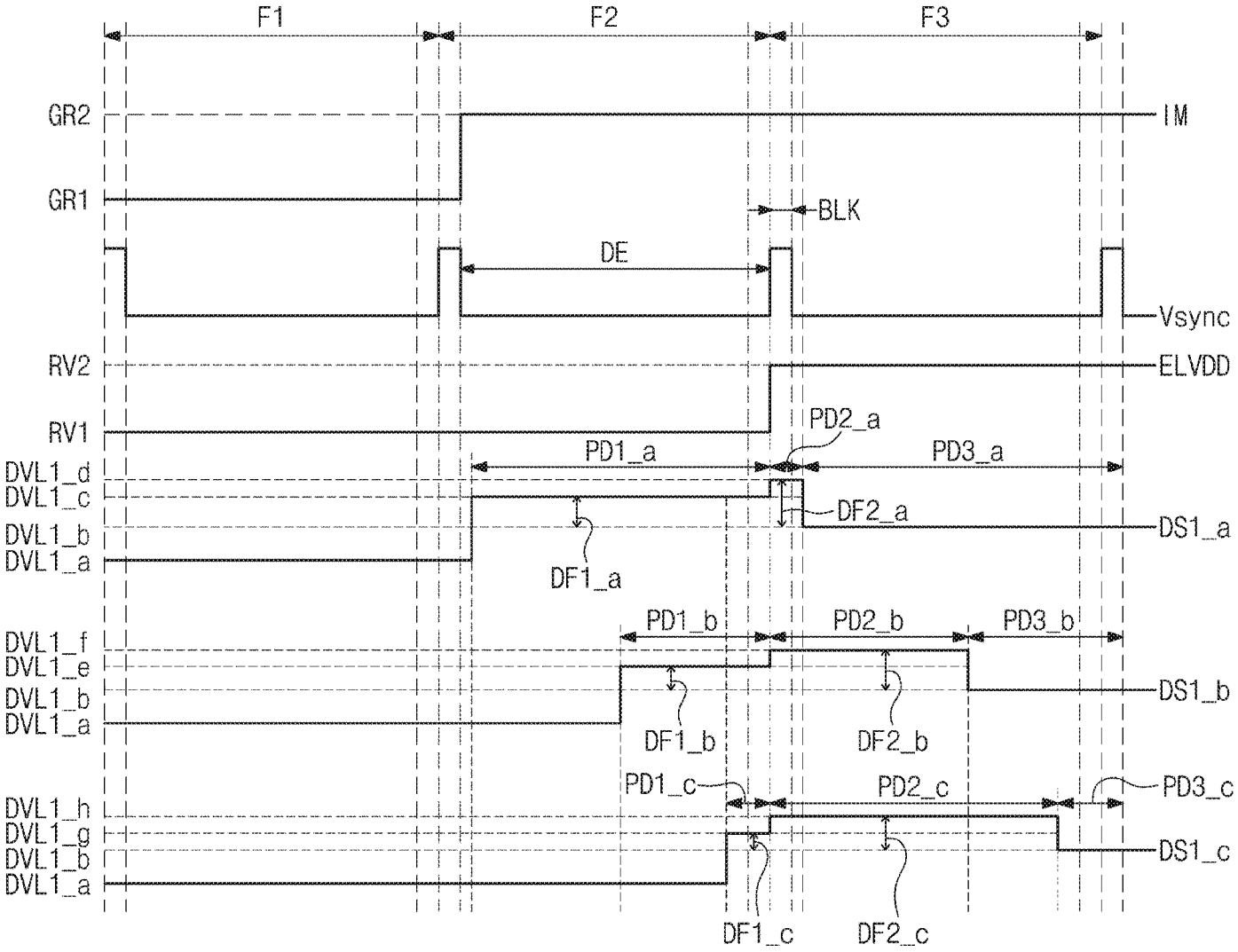
FIGS. 11A and 11B illustrate embodiments of driving voltage and data signal waveforms.
Figure 11B:
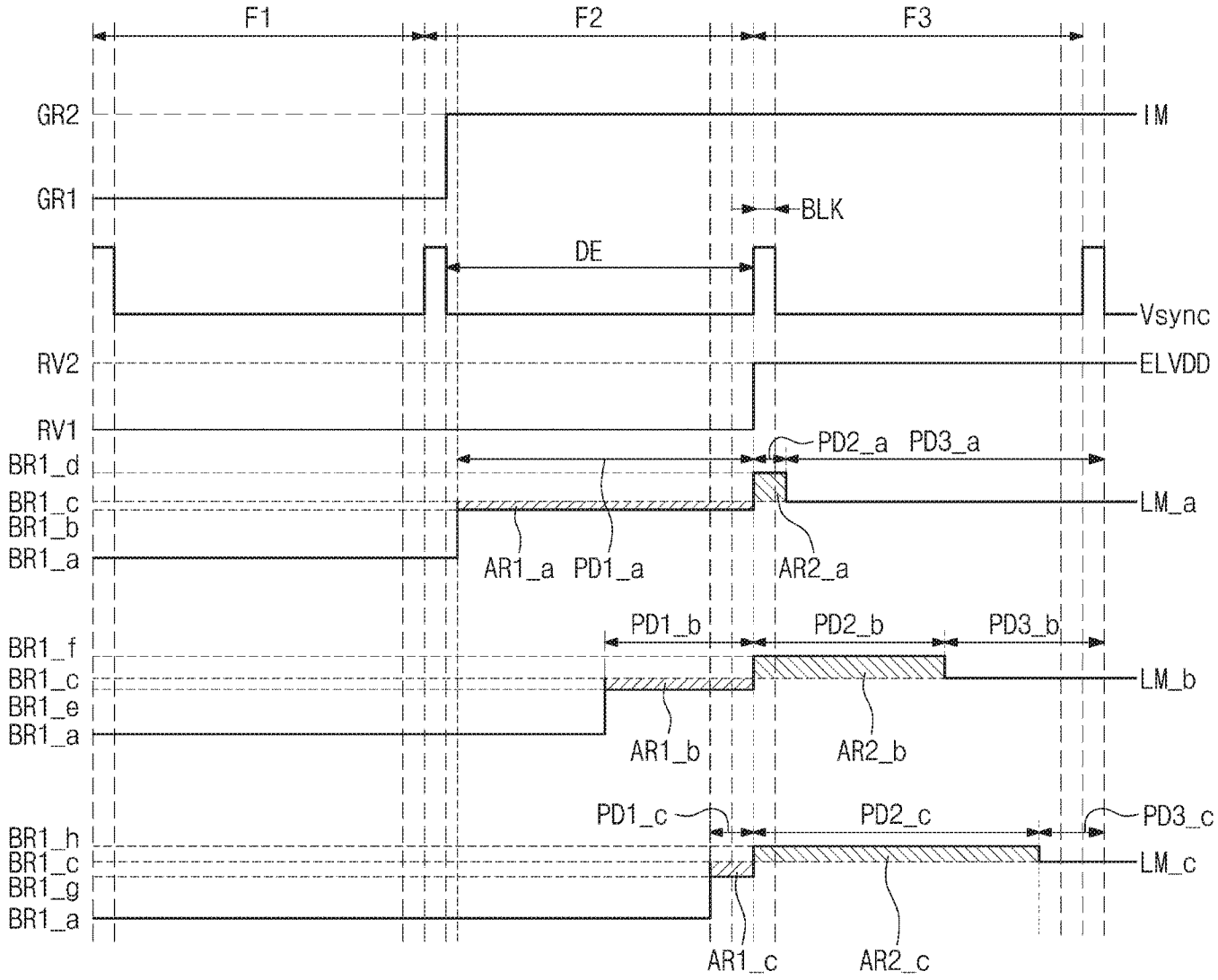

FIGS. 11A and 11B are waveform diagrams explaining a variation in voltage level of the driving voltage and a variation in voltage level of the data signal as a function of the position of the pixel when the grayscale of the image increases. In FIGS. 11A and 11B, like reference numerals may denote like signals as in FIG. 8.

FIG. 11A shows a voltage level of a first line data signal DS1_*a* applied to the first pixel PX11, a voltage level of a second line data signal DS1_*b* applied to the second pixel PXk1, and a voltage level of a third line data signal DS1_*c* applied to the third pixel PXn1 (e.g., refer to FIG. 9).

The first line data signal DS1_*a* may include a fourth period PD1_*a*, a fifth period PD2_*a*, and a sixth period PD3_*a* and the second line data signal DS1_*b* may include a seventh period PD1_*b*, an eighth period PD2_*b*, and a ninth period PD3_*b*. The third line data signal DS1_*c* may include a tenth period PD1_*c*, an eleventh period PD2_*c*, and a twelfth period PD3_*c*.

The image IM in the first frame F1 may have the first grayscale value GR1, and the image IM in the second frame F2 may have the second grayscale value GR2 greater than the first grayscale GR1. Accordingly, the first line data signal DS1_*a* of the fourth period PD1_*a* in the second frame F2 may be generated based on the correction image signals that are corrected by the data generator DGP_a (e.g., refer to FIG. 10).

The image IM in the second frame F2 may have the second grayscale value GR2, and the image IM in the third frame F3 may also have the second grayscale value GR2. Accordingly, the first line data signal DS1_*a* of the sixth period PD3_*a* in the third frame F3 may be generated based on the image signals that are not corrected by the data generator DGP_a.

The level difference between a third data level DVL1_*c* of the first line data signal DS1_*a* in the fourth period PD1_*a* and a second data level DVL1_*b* of the first line data signal DS1_*a* in the sixth period PD3_*a* may be referred to as a first difference DF1_*a*.

The level difference between a fifth data level DVL1_*e* of the second line data signal DS1_*b* in the seventh period PD1_*b* and a second data level DVL1_*b* of the second line data signal DS1_*b* in the ninth period PD3_*b* may be referred to as a second difference DF1_*b*.

The level difference between a seventh data level DVL1_*g* of the third line data signal DS1_*c* in the tenth period PD1_*c* and a second data level DVL1_*b* of the third line data signal DS1_*c* in the twelfth period PD3_*c* may be referred to as a third difference DF1_*c*. Also, as an example, the first difference DF1_*a* may be greater than the second difference DF1_*b*, and the second difference DF1_*b* may be greater than the third difference DF1_*c*.

FIG. 11B shows a first brightness LM_a of the first pixel PX11, a second brightness LM_b of the second pixel PXk1, and a third brightness LM_c of the third pixel PXn1. The first brightness LM_a may include the fourth period PD1_*a*, the fifth period PD2_*a*, and the sixth period PD3_*a*. The second brightness LM_b may include the seventh period PD1_*b*, the eighth period PD2_*b*, and the ninth period PD3_*b*. The third brightness LM_c may include the tenth period PD1_*c*, the eleventh period PD2_*c*, and the twelfth period PD3_*c*.

Referring to FIGS. 11A and 11B, the width of the fourth period PD1_*a* may be greater than the width of the seventh period PD1_*b*. The width of the seventh period PD1_*b* may be greater than the width of the tenth period PD1_*c*. This is because the timing at which the first line data signal DS1_*a* (having the third data level DVL1_*c*) is applied to the first pixel PX11 in the second frame F2 precedes the timing at which the second line data signal DS1_*b* (having the fifth data level DVL1_e) is applied to the second pixel PXk1 in the second frame F2. In addition, this is because the timing at which the second line data signal DS1_b (having the fifth data level DVL1_e) is applied to the second pixel PXk1 in the second frame F2 precedes the timing at which the third line data signal DS1_c (having the seventh data level DVL1_g) is applied to the third pixel PXn1 in the second frame F2.

On the other hand, the width of the fifth period PD2_a may be less than the width of the eighth period PD2_b. The width of the eighth period PD2_b may be less than the width of the eleventh period PD2_c. This is because the timing at which the first line data signal DS1_a having the second data level DVL1_b is applied to the first pixel PX11 in the third frame F3 precedes the timing at which the second line data signal DS1_b (having the second data level DVL1_b) is applied to the second pixel PXk1 in the third frame F3 after the voltage level of the first driving voltage ELVDD is changed to the second voltage level RV2 from the first voltage level RV1. In addition, this is because the timing at which the second line data signal DS1_b (having the second data level DVL1_b) is applied to the second pixel PXk1 in the third frame F3 precedes the timing at which the third line data signal DS1_c (having the second data level DVL1_b) is applied to the third pixel PXn1 in the third frame F3.

The first brightness LM_a in the fourth period PD1_a may decrease by a first area AR1_a compared with the first brightness LM_a in the sixth period PD3_a. The first brightness LM_a in the fifth period PD2_a may increase by a second area AR2_a compared with the first brightness LM_a in the sixth period PD3_a.

The second brightness LM_b in the seventh period PD1_b may decrease by a third area AR1_b compared with the second brightness LM_b in the ninth period PD3_b. The second brightness LM_b in the eighth period PD2_b may increase by a fourth area AR2_b compared with the second brightness LM_b in the ninth period PD3_b.

The third brightness LM_c in the tenth period PD1_c may decrease by a fifth area AR1_c compared with the third brightness LM_c in the twelfth period PD3_c. The third brightness LM_c in the eleventh period PD2_c may increase by a sixth area AR2_c compared with the third brightness LM_c in the twelfth period PD3_c.

As an example, the data generator DGP_a may correct the image signals such that the first area AR1_a and the second area AR2_a become substantially equal to each other. The data generator DGP_a may correct the image signals such that the third area AR1_b and the fourth area AR2_b become substantially equal to each other. The data generator DGP_a may correct the image signals such that the fifth area AR1_c and the sixth area AR2_c may become substantially equal to each other. (In one embodiment, the term "substantially" may indicate to within a predetermined tolerance).

Figure 12A:
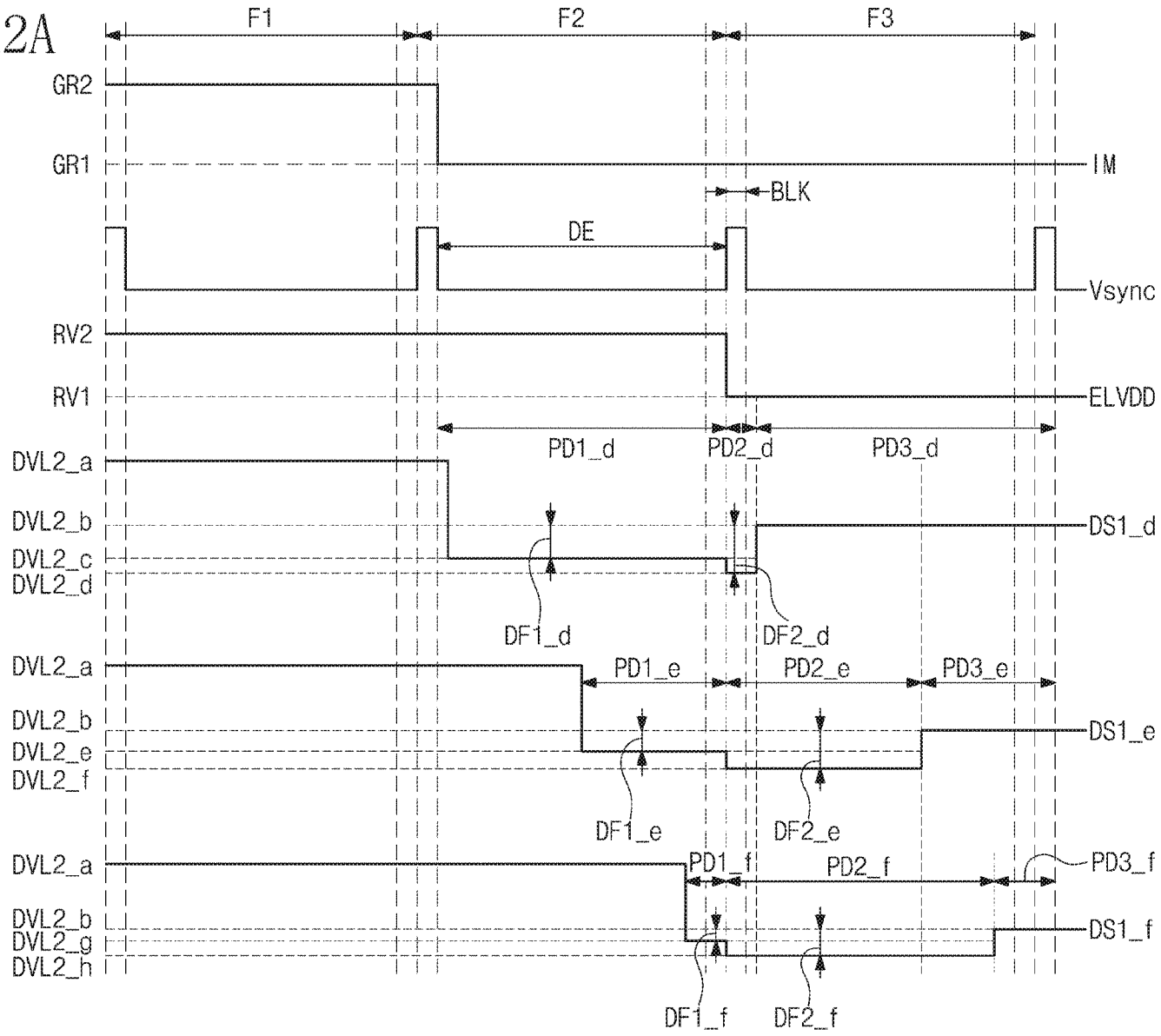
FIGS. 12A and 12B illustrate embodiments of driving voltage and data signal waveforms.
Figure 12B:
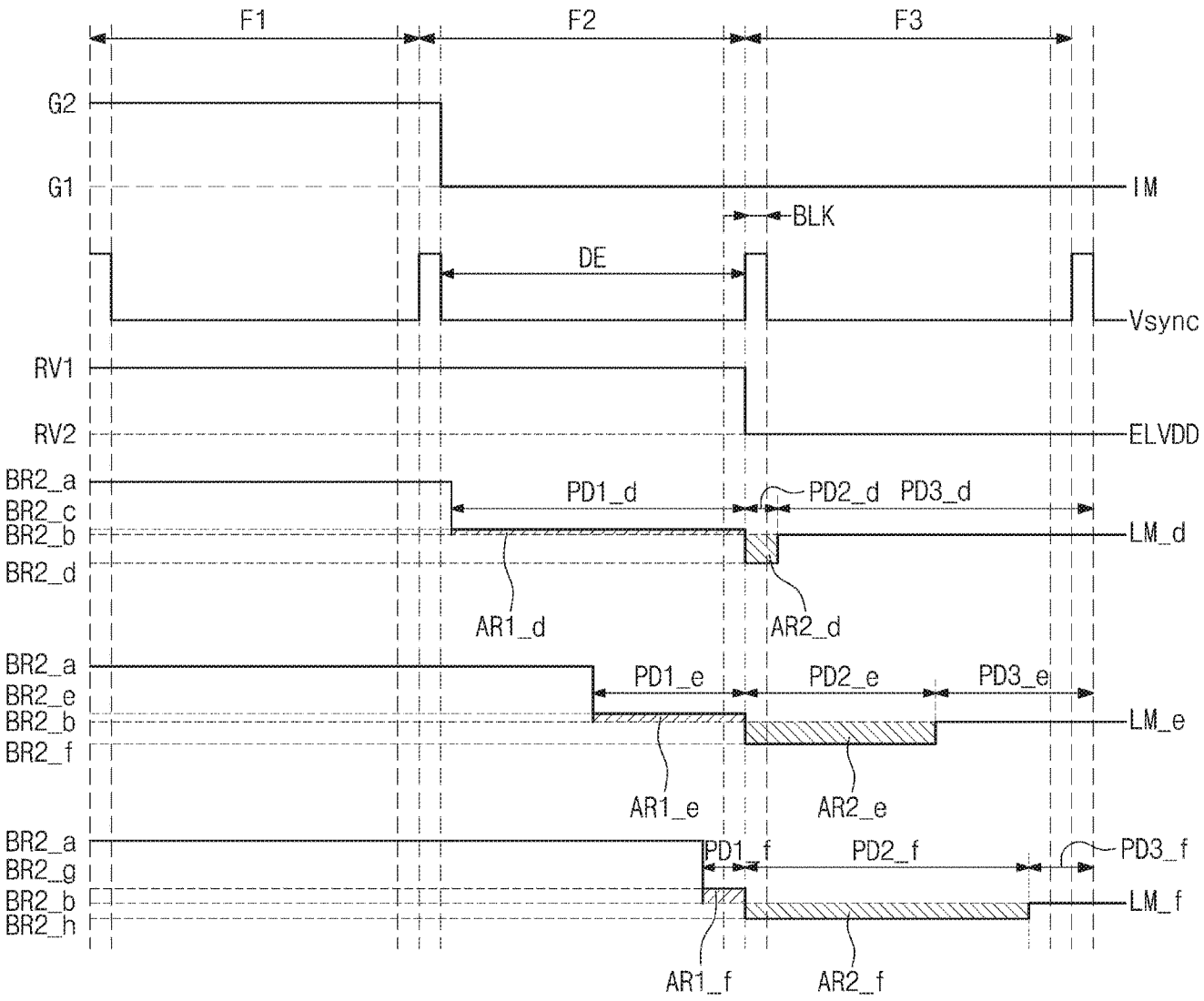

FIGS. 12A and 12B are waveform diagrams explaining a variation in voltage level of the driving voltage and a variation in voltage level of the data signal as a function of a position of a pixel when a grayscale of an image decreases. In FIGS. 12A and 12B, like reference numerals may denote like signals in FIGS. 8, 11A, and 11B.

Referring to FIGS. 12A and 12B, the image IM having the second grayscale GR2 may be displayed in the first frame F1, and the image IM having the first grayscale GR1 may be displayed in the second and third frames F2 and F3.

As an example, the width of a fourth period PD1_d may be greater than the width of a seventh period PD1_e. The width of the seventh period PD1_e may be greater than the width of a tenth period PD1_f. This is because the timing at which a first line data signal DS1_d (having a third data level DVL2_c) is applied to the first pixel PX11 in the second frame F2 precedes the timing at which a second line data signal DS1_e (having a fifth data level DVL2_e) is applied to the second pixel PXk1 in the second frame F2 (e.g., refer to FIG. 9). In addition, this is because the timing at which the second line data signal DS1_e (having the fifth data level DVL2_e) is applied to the second pixel PXk1 in the second frame F2 precedes the timing at which a third line data signal DS1_f (having a seventh data level DVL2_g) is applied to the third pixel PXn1 in the second frame F2.

On the other hand, the width of a fifth period PD2_d may be less than the width of an eighth period PD2_e. The width of the eighth period PD2_e may be less than the width of the eleventh period PD2_f. This because the timing at which the first line data signal DS1_d (having a second data level DVL2_b) is applied to the first pixel PX11 in the third frame F3 precedes the timing at which the second line data signal DS1_e (having the second data level DVL2_b) is applied to the second pixel PXk1 in third frame F3 after the voltage level of the first driving voltage ELVDD is changed to the first voltage level RV1 from the second voltage level RV2. This is because the timing at which the second line data signal DS1_e (having the second data level DVL2_b) is applied to the second pixel PXk1 in the third frame F3 precedes the timing at which the third line data signal DS1_f (having the second data level DVL2_b) is applied to the third pixel PXn1 in the third frame F3.

A first brightness LM_d in the fourth period PD1_d may increase by a first area AR1_d compared with the first brightness LM_d in a sixth period PD3_d. The first brightness LM_d in the fifth period PD2_d may decrease by a second area AR2_d compared with the first brightness LM_d in the sixth period PD3_d.

A second brightness LM_e in the seventh period PD1_e may increase by a third area AR1_e compared with the second brightness LM_e in a ninth period PD3_e. The second brightness LM_e in the eighth period PD2_e may decrease by a fourth area AR2_e compared with the second brightness LM_e in the ninth period PD3_e.

A third brightness LM_f in the tenth period PD1_f may increase by a fifth area AR1_f compared with the third brightness LM_f in a twelfth period PD3_f. The third brightness LM_f in the eleventh period PD2_f may decrease by a sixth area AR2_f compared with the third brightness LM_f in the twelfth period PD3_f.

As an example, the data generator DGP_a (e.g., refer to FIG. 9) may correct the image signals such that the first area AR1_d and the second area AR2_d may become substantially equal to each other. The data generator DGP_a may correct the image signals such that the third area AR1_e and the fourth area AR2_e may become substantially equal to each other. The data generator DGP_a may correct the image signals such that the fifth area AR1_f and the sixth area AR2_f may become substantially equal to each other.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods herein.

Also, another embodiment may include a computer-readable medium, e.g., a non-transitory computer-readable medium, for storing the code or instructions described above. The computer-readable medium may be a volatile or non-volatile memory or other storage device, which may be removably or fixedly coupled to the computer, processor, controller, or other signal processing device which is to execute the code or instructions for performing the method embodiments or operations of the apparatus embodiments herein.

The controllers, processors, blocks, compensators, devices, modules, units, multiplexers, logic, interfaces, decoders, drivers, generators and other signal generating and signal processing features of the embodiments disclosed herein may be implemented, for example, in non-transitory logic that may include hardware, software, or both. When implemented at least partially in hardware, the controllers, processors, devices, modules, blocks, compensators, units, multiplexers, generators, logic, interfaces, decoders, drivers, and other signal generating and signal processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the controllers, processors, devices, modules, units, blocks, compensators, multiplexers, generators, logic, interfaces, decoders, drivers, and other signal generating and signal processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

Although the embodiments of the present disclosure have been described, it is understood that the present disclosure should not be limited to these embodiments but various changes and modifications can be made by one ordinary skilled in the art within the spirit and scope of the present disclosure as hereinafter claimed. Therefore, the disclosed subject matter should not be limited to any single embodiment described herein, and the scope of the present inventive concept shall be determined according to the attached claims. The embodiments may be combined to form additional embodiments.

What is claimed is:

1. A display device, comprising:

a display panel configured to display an image;

a controller configured to generate image data and to generate a first control signal and a second control signal in response to a first image signal and a second image signal;

a panel driver configured to receive the image data and the first control signal from the controller and to generate a driving signal in response to the image data and the first control signal to drive the display panel; and a voltage generator configured to generate a driving voltage to drive the display panel and to change a voltage level of the driving voltage in response to the second control signal, wherein the first image signal corresponds to a second frame located before a third frame in which the driving voltage is changed, wherein the second image signal corresponds to a first frame located before the second frame, and wherein the controller is configured to generate the image data corresponding to the second frame in response to the first image signal and the second image signal.

2. The display device of claim 1, wherein the voltage generator is configured to change a voltage level of the driving voltage in the third frame when a grayscale value of the first image signal is different from a grayscale value of the second image signal.

3. The display device of claim 2, wherein:

the controller generates the image data corresponding to the second frame in response to the first image signal and a correction signal, and the correction signal is generated based on a difference between the grayscale value of the first image signal and the grayscale value of the second image signal.

4. The display device of claim 3, wherein the correction signal comprises information corresponding to the voltage level of the driving voltage, which is changed in response to the second control signal.

5. The display device of claim 4, wherein:

the first control signal includes a source control signal and a gate control signal, and the panel driver comprises:

a source driver configured to receive the image data and the source control signal, generate a data signal in response to the image data, and transmit the data signal to the display panel; and a gate driver comprising a first scan line and a second scan line, the gate driver configured to sequentially transmit scan signals generated in response to the gate control signal to the display panel via the first and second scan lines.

6. The display device of claim 5, wherein the voltage generator is configured to change the voltage level of the driving voltage in the third frame to be greater than a voltage level of the driving voltage in the second frame when the grayscale value of the first image signal is greater than the grayscale value of the second image signal.

7. The display device of claim 6, wherein:

the controller is configured to generate a correction image signal in response to the first image signal and the correction signal and to generate the image data corresponding to the second frame based on the correction image signal, and the correction image signal has a grayscale value greater than the grayscale value of the first image signal.

8. The display device of claim 5, wherein the voltage generator is configured to change the voltage level of the driving voltage in the third frame to be less than a voltage level of the driving voltage in the second frame when the grayscale value of the first image signal is less than the grayscale value of the second image signal.

9. The display device of claim 8, wherein:

the controller is configured to generate a correction image signal in response to the first image signal and the correction signal and to generate the image data corresponding to the second frame based on the correction image signal, and the correction image signal has a grayscale value less than the grayscale value of the first image signal.

10. The display device of claim 5, wherein:

the first image signal comprises a first sub-image signal corresponding to the first scan line and a second sub-image signal corresponding to the second scan line, the correction signal comprises a first sub-correction signal corresponding to the first scan line and a second sub-correction signal corresponding to the second scan line, the controller is configured to generate a first sub-correction image signal in response to the first sub-image signal and the first sub-correction signal, a second sub-correction image signal in response to the second sub-image signal and the second sub-correction signal, and the image data corresponding to the second frame in response to the first and second sub-correction image signals, and a grayscale value of the first sub-correction image signal is different from a grayscale value of the second sub-correction image signal.

11. The display device of claim 10, wherein the voltage generator is configured to change the voltage level of the driving voltage in the third frame to be greater than a voltage level of the driving voltage in the second frame when the grayscale value of the first image signal is greater than the grayscale value of the second image signal.

12. The display device of claim 11, wherein the grayscale value of the first sub-correction image signal is greater than the grayscale value of the second sub-correction image signal.

13. The display device of claim 10, wherein the voltage generator is configured to change the voltage level of the driving voltage in the third frame to be less than the voltage level of the driving voltage in the second frame when the grayscale value of the first image signal is less than the grayscale value of the second image signal.

14. The display device of claim 13, wherein the grayscale value of the first sub-correction image signal is less than the grayscale value of the second sub-correction image signal.

15. The display device of claim 1, wherein the controller comprises a data generator configured to generate the image data corresponding to the second frame in response to the first and second image signals.

16. The display device of claim 15, wherein the data generator comprises:

a memory configured to store the second image signal;

a compensator configured to receive the first and second image signals and to generate a correction image signal based on a correction signal, the correction signal generated in response to a difference between a grayscale value of the first image signal and a grayscale value of the second image signal; and a generator configured to generate the image data corresponding to the second frame in response to the correction image signal.

17. The display device of claim 16, wherein the data generator further comprises:

a look-up table configured to store a correction table generated based on the difference between the grayscale value of the first image signal and the grayscale value of the second image signal, and the compensator is configured to read out, from the correction table, the correction signal which corresponds to the difference between the grayscale value of the first image signal and the grayscale value of the second image signal.

18. The display device of claim 17, wherein the correction signal comprises information corresponding to the voltage level of the driving voltage, which is changed in response to the second control signal.

19. The display device of claim 16, wherein the panel driver comprises:

a gate driver comprising a first scan line and a second scan line, wherein the gate driver is configured to sequentially transmit to the display panel scan signals generated in response to the first control signal via the first and second scan lines, the first image signal comprises a first sub-image signal corresponding to the first scan line and a second sub-image signal corresponding to the second scan line, and the correction signal comprises a first sub-correction signal corresponding to the first scan line and a second sub-correction signal corresponding to the second scan line.

20. The display device of claim 19, wherein the correction image signal comprises:

a first sub-correction image signal corresponding to the first scan line and a second sub-correction image signal corresponding to the second scan line, the compensator is configured to generate the first sub-correction image signal in response to the first sub-image signal and the first sub-correction signal and to generate the second sub-correction image signal in response to the second sub-image signal and the second sub-correction signal, and a grayscale value of the first sub-correction image signal is different from a grayscale value of the second sub-correction image signal.

21. The display device of claim 1, wherein:

the display panel comprises a plurality of pixels, the driving voltage comprises a first driving voltage and a second driving voltage having a voltage level less than a voltage level of the first driving voltage, and one of the plurality of pixels comprises:

a light emitting diode;

a first power line configured to receive the first driving voltage;

a driving transistor electrically connected between the first power line and an anode of the light emitting diode; and a second power line electrically connected to a cathode of the light emitting diode and receiving the second driving voltage.

22. The display device of claim 21, wherein the voltage generator is configured to change the voltage level of the first driving voltage.

* * * * *